US007102962B2

(12) United States Patent
Suzuki

(10) Patent No.: US 7,102,962 B2
(45) Date of Patent: Sep. 5, 2006

(54) TIMEPIECE EQUIPPED WITH CALENDAR MECHANISM INCLUDING FIRST AND SECOND DATE INDICATORS

(75) Inventor: Shigeo Suzuki, Chiba (JP)

(73) Assignee: Seiko Instruments Inc., (JP)

( * ) Notice: Subject to any disclaimer, the term of this patent is extended or adjusted under 35 U.S.C. 154(b) by 0 days.

(21) Appl. No.: 11/313,776

(22) Filed: Dec. 21, 2005

(65) Prior Publication Data

US 2006/0133214 A1 Jun. 22, 2006

(30) Foreign Application Priority Data

Dec. 22, 2004 (JP) ..... 2004-371537

(51) Int. Cl.
*G04B 19/20* (2006.01)
*G04B 19/24* (2006.01)

(52) U.S. Cl. ..... 368/37

(58) Field of Classification Search ..... 268/28, 268/35, 37, 38

See application file for complete search history.

(56) References Cited

U.S. PATENT DOCUMENTS 2,976,672 A * 3/1961 Ducommun ..... 368/37
3,982,388 A * 9/1976 Guyot et al. ..... 368/35
4,257,113 A * 3/1981 Meister et al. ..... 368/35
6,081,483 A * 6/2000 Capt et al. ..... 368/28
6,574,167 B1 * 6/2003 Weissbach et al. ..... 368/35
6,711,100 B1 * 3/2004 Rochat et al. ..... 368/35
6,958,952 B1 * 10/2005 Gabathuler et al. ..... 368/28
7,023,762 B1 * 4/2006 Burkhardt et al. ..... 368/35
2003/0193840 A1 * 10/2003 Huter ..... 368/37
2005/0088917 A1 * 4/2005 Dalloz ..... 368/37
2005/0169109 A1 * 8/2005 Watanabe ..... 368/37
2005/0174891 A1 * 8/2005 Besse ..... 368/37

FOREIGN PATENT DOCUMENTS

JP 2000-147148 * 5/2000

* cited by examiner

*Primary Examiner*—Vit W. Miska
(74) *Attorney, Agent, or Firm*—Adams & Wilks

(57) ABSTRACT

A calendar mechanism-equipped timepiece having a compactly constructed drive mechanism for driving first and second date indicators is offered. A timepiece equipped with a calendar mechanism has a drive mechanism, time display wheels, a first date indicator for displaying the ones digit of the date, a second date indicator for displaying the tens digit of the date, and a program wheel capable of intermittently rotating the first date indicator and the second date indicator based on the operation of the drive mechanism. The center axis of rotation of the time display wheels is located within the center hole of the program wheel under the condition where the time display wheels are rotatable. The first and second date indicators are placed in position adjacently to each other. Information about the date can be displayed from a window in the dial by one of the first date characters on the first date indicator and one of the second date characters on the second date indicator.

8 Claims, 24 Drawing Sheets

TIMEPIECE EQUIPPED WITH CALENDAR MECHANISM INCLUDING FIRST AND SECOND DATE INDICATORS

BACKGROUND OF THE INVENTION

1. Field of the Invention

The present invention relates to a timepiece equipped with a calendar mechanism including a first date indicator for displaying the ones digit of the date and a second date indicator for displaying the tens digit of the date. More particularly, the present invention relates to a timepiece equipped with a calendar mechanism and designed such that the center axis of rotation of the time display wheels is located inside the center hole in a program gear.

2. Description of the Prior Art (1) Description of Terminology

Generally, the mechanical body of a timepiece including the driver portion is referred to as the "movement". A dial and hands are attached to the movement and put into a timepiece case, forming a completed product. This state is referred to as the "completed" state of the timepiece. A bottom plate or movement plate forms the base plate of the timepiece. The side of the bottom plate which faces the timepiece case glass or on the side of the dial is referred to as the "rear side", "glass side", or "dial side" of the movement. The other side of the bottom plate which faces the rear cover of the timepiece case (i.e., which faces away from the dial) is referred to as the "front side" or "rear cover side" of the movement. A train wheel incorporated on the "front side" of the movement is referred to as the "front train wheel". A train wheel incorporated on the "rear side" of the movement is referred to as the "rear train wheel". Generally, "12 o'clock side" indicates a side of an analog timepiece on which a scale mark corresponding to the 12 o'clock on a dial is disposed. "12 o'clock direction" indicates a direction directed toward the "12 o'clock side" of an analog timepiece from the center of rotation of hands or fingers. "3 o'clock side" indicates a side of an analog timepiece on which a scale mark corresponding to the 3 o'clock on the dial is disposed. "3 o'clock direction" indicates a direction directed from the center of rotation of fingers or hands of an analog timepiece toward the "3 o'clock side". Furthermore, "6 o'clock side" indicates a side of an analog timepiece on which a scale mark corresponding to the 6 o'clock on the dial is disposed. "6 o'clock direction" indicates a direction directed from the center of rotation of fingers or hands of an analog timepiece toward the "6 o'clock side". In addition, "9 o'clock side" indicates a side of an analog timepiece on which a scale mark corresponding to the 9 o'clock on the dial is disposed. "9 o'clock direction" indicates a direction directed from the center of rotation of fingers or hands of an analog timepiece toward the "9 o'clock side". Additionally, sides on which other scale marks on the dial such as "2 o'clock direction" and "2 o'clock side" are disposed may be indicated.

(2) Prior Art Timepieces with Calendar Mechanism

The structure of the prior art timepiece equipped with a calendar mechanism including a first date indicator for displaying the ones digit of the date and a second date indicator for displaying the tens digit of the date is described below.

(2-1) Calendar Mechanism-Equipped Timepiece of the Prior Art First Type

Referring to FIG. 25, a calendar mechanism-equipped timepiece of the prior art first type has two date indicators 822 and 824 which overlap each other at least partially. The first date indicator 822 provides a display of the ones digit of the date, while the second date indicator 824 provides a display of the tens digit of the date. A drive mechanism includes a 24-hour wheel 820 rotated once every 24 hours by rotation of an hour wheel 816, an operating lever 844 operated by rotation of the 24-hour wheel 820, other gears for control and the like. A program wheel 850 is rotated by operation of the operating lever 844. A first date indicator driving wheel 852 rotates the first date indicator 822. A second date indicator driving wheel 854 rotates the second date indicator 824. Rotation of the first date indicator 822 is corrected or regulated by a first date indicator jumper 862. Rotation of the second date indicator 824 is corrected or regulated by a second date indicator jumper 864 (for example, see EP 1,070,996 A1).

(2-2) Calendar Mechanism-Equipped Timepiece of the Prior Art Second Type

Referring to FIG. 26, a calendar mechanism-equipped timepiece of the prior art second type has an ones disc 932 for displaying the "ones" digit of the date and a tens disc 931 for displaying the "tens" digit of the date. An ones pinion 933 is fixedly mounted to the ones disc 932. An ones jumper 936 maintains the angular position of the ones pinion 933. A tens pinion 934 is fixedly mounted to the tens disc 931. A tens jumper 940 maintains the angular position of the tens pinion 934. The ones pinion 933 is in mesh with the upper half of the tooth row of a date gear 908. The hooks of a drive device 906 are in mesh with the tooth row of the date gear 908, thus advancing the teeth of the date gear 908 one pitch each day. The tens pinion 934 is driven one pitch at a time by an intermediate movable part 937. The intermediate movable part 937 is driven one pitch at a time by the date gear 908 via an idle gear 938 (for example, see JP-A-2000-147148).

In the timepiece equipped with the prior art calendar mechanism of the first type, the drive mechanism for driving the first date indicator 822 and the second date indicator 824 includes the 24-hour wheel 820, the operating lever 844, other controlling gears, and so on. Therefore, the drive mechanism is complex in structure. There is the problem that the drive mechanism occupies a large area. Furthermore, in the timepiece equipped with the prior art calendar mechanism of the second type, the tens pinion 934 is driven by the date gear 908 via the intermediate movable part 937 and idle gear 938 and, therefore, the drive mechanism for driving the tens disc 931 is complex in structure. There is the problem that the drive mechanism occupies a large area. Furthermore, timepieces with the prior art calendar mechanism have problems that the drive mechanism is complex and that wide latitude is not offered in designing the calendar correction mechanism.

SUMMARY OF THE INVENTION

It is an object of the present invention to provide a calendar mechanism-equipped timepiece which includes first and second date indicators, has a simple drive mechanism for driving the first and second date indicators, and is designed compactly. Furthermore, it is another object of the present invention to provide a calendar mechanism-equipped timepiece of the present invention which offers wide latitude in designing the calendar correction mechanism.

The present invention can achieve a timepiece equipped with a calendar mechanism including two date indicators, the timepiece comprising a drive mechanism for driving the timepiece equipped with the calendar mechanism, time display wheels for displaying time information by being rotated by operation of the drive mechanism, a first date indicator for displaying the ones digit of the date, a second date indicator for displaying the tens digit of the date, and a program gear designed to be capable of intermittently rotating the first and second date indicators based on the operation of the drive mechanism. The center axis of rotation of the time display wheels is located inside a center hole in the program gear while the time display wheels are rotatable. Information about the date or day can be displayed by means of one of first day characters provided on the first date indicator and one of second day characters provided on the second date indicator, the first and second date indicators being placed in position adjacently to each other. Because of this structure, a calendar mechanism-equipped timepiece in which the drive mechanism for driving the first and second date indicators has been easily and compactly constructed can be accomplished.

In the calendar mechanism-equipped timepiece of the present invention, the center axis of rotation of the program gear is preferably set coincident with the center axis of rotation of the time display wheels. Furthermore, in the calendar mechanism-equipped timepiece of the present invention, the program gear preferably includes a program date indicator designed to be rotated based on operation of the drive mechanism, a first program gear designed to be capable of rotating as a unit with the program date indicator and of intermittently rotating the first date indicator, and a second program gear designed to be capable of rotating as a unit with the program date indicator and of intermittently rotating the second date indicator. Because of this structure, a compactly constructed timepiece with calendar mechanism can be accomplished.

In the calendar mechanism-equipped timepiece of the present invention, the program date indicator can have 31 tooth portions for accepting operation of the drive mechanism. The first program gear can have 30 tooth portions for rotating the first date indicator. The second program gear can have 8 tooth portions for rotating the second date indicator. The first date indicator can have a first date character display surface bearing 10 digits "1", "2", "3", "4", "5", "6", "7""8", "9", and "0"arrayed in this order in a peripheral direction. The second date indicator can have a second date character display surface bearing 8 digits "0", "0", "1", "1", "2", "2", "3", and "3" arrayed in this order in the peripheral direction. Because of this structure, a calendar mechanism-equipped timepiece including a large calendar display which is easy to see can be accomplished.

In the calendar mechanism-equipped timepiece of the present invention, the program date indicator can have 31 tooth portions for accepting operation of the drive mechanism. The first program gear can have 30 tooth portions for rotating the first date indicator. The second program gear can have 4 tooth portions for rotating the second date indicator. The first date indicator can have a first date character display surface bearing 10 digits "1", "2", "3", "4", "5", "6", "7", "8", "9", and "0" arrayed in this order in a peripheral direction. The second date indicator can have a second date character display surface bearing 8 digits "0", "1", "2", "3", "0", "1", "2", and "3" arrayed in this order in the peripheral direction. Because of this structure, a calendar mechanism-equipped timepiece including a large calendar display which is easy to see can be accomplished.

The calendar mechanism-equipped timepiece of the present invention is provided with a day indicator intermediate driving wheel designed to be rotated based on operation of the drive mechanism and be arranged to overlap the program gear, a day indicator driving wheel designed to be rotated based on rotation of the day indicator intermediate driving wheel, and a day indicating driving pawl designed to be rotated based on rotation of the day indicator driving wheel. The program date indicator is preferably designed to be rotated based on rotation of the day indicator driving pawl. Because of this structure, a compactly constructed calendar mechanism-equipped timepiece can be accomplished. The calendar mechanism-equipped timepiece of the present invention preferably has a program date indicator jumper for correcting or resetting rotation of the program date indicator, a first date indicator jumper for correcting or resetting rotation of the first date indicator, and a second date indicator jumper for correcting or resetting rotation of the second date indicator. Because of this structure, the rotations of the program date indicator, first date indicator, and second date indicator can be corrected or reset at the same time and reliably.

The calendar mechanism-equipped timepiece of the present invention can have a calendar correction mechanism capable of correcting contents of display of the first date indicator and/or contents of display of the second date indicator by rotating a stem under conditions where the stem has been pulled out into a stem position where a calendar correction can be made. The calendar correction mechanism can include a calendar correction wheel. The calendar correction wheel is rotated based on rotation of the stem under conditions where the stem has been pulled out into the stem position where a calendar correction can be made, whereby the program wheel can be rotated. In the calendar mechanism-equipped timepiece of the present invention, the center axis of rotation of the time display wheel can be located inside a center hole in the program gear under conditions where the time display wheels are rotatable. Since the outside diameter dimension of the program gear can be set large, large latitude can be offered in designing the calendar correction mechanism.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Embodiments of the calendar mechanism-equipped timepiece of the present invention are hereinafter described based on the drawings.

(1) Structure of First Embodiment of Calendar Mechanism-Equipped Timepiece of the Present Invention A first embodiment of the calendar mechanism-equipped timepiece of the present invention is first described. The first embodiment of the calendar mechanism-equipped timepiece of the present invention is an embodiment in which a timepiece equipped with a calendar mechanism is constructed with a mechanical timepiece having an automatic winding mechanism.

(1-1) Structure of Front Side of Movement

Figure 5:
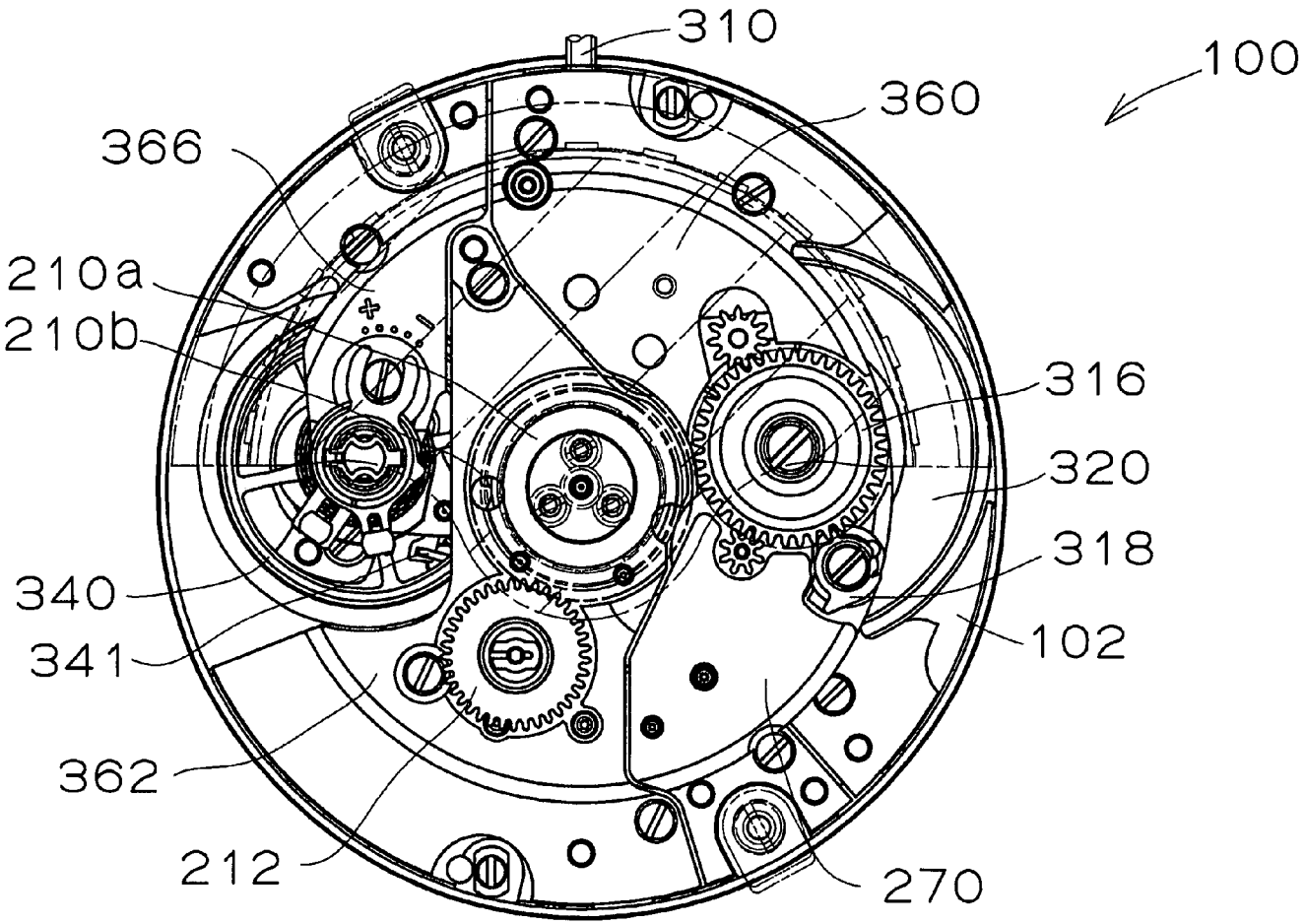
FIG. 5 is a schematic plan view showing a structure when the movement is viewed from the rear cover side in the first embodiment of the calendar mechanism-equipped timepiece of the present invention.
Figure 6:
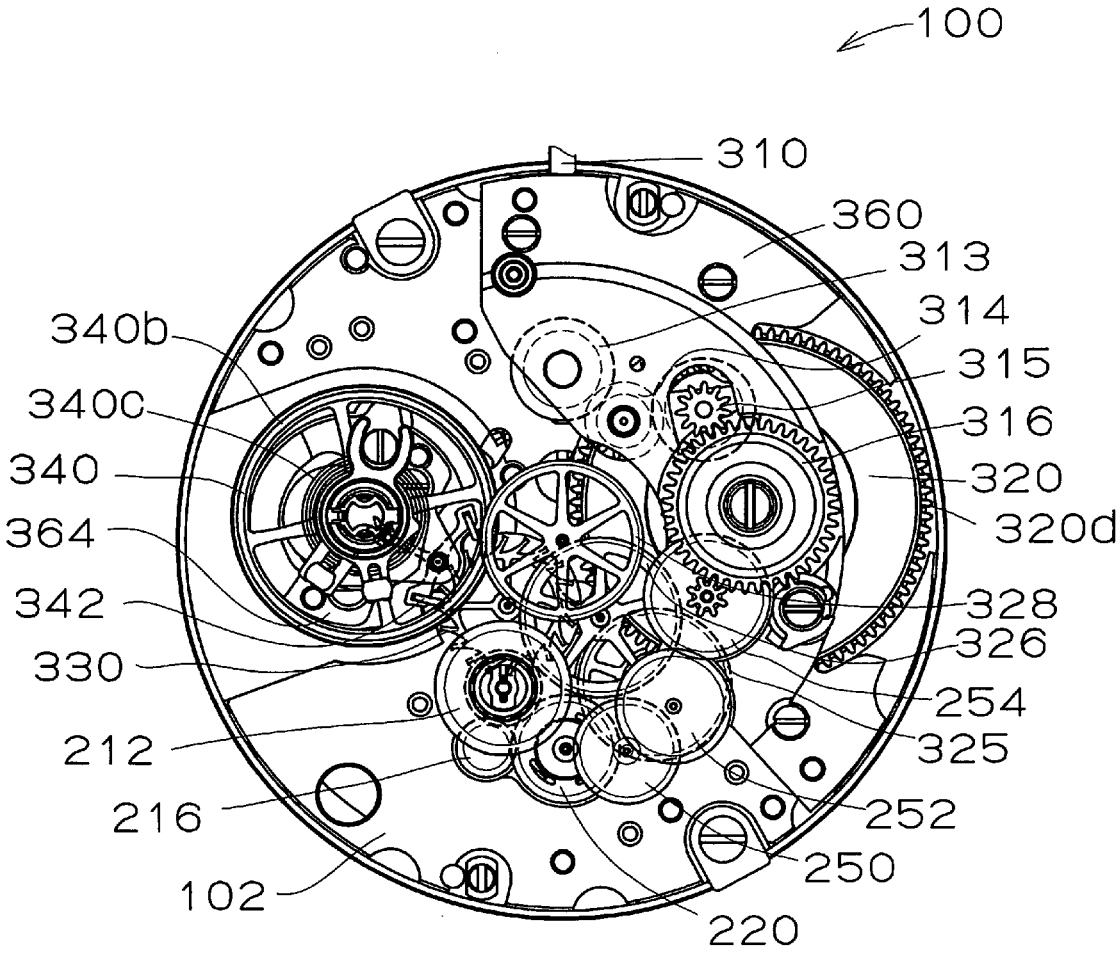
FIG. 6 is a schematic plan view showing a structure when the movement from which balance bridge, train wheel bridge, and automatic winding train wheel bridge have been removed is viewed from the rear cover side in the first embodiment of the calendar mechanism-equipped timepiece of the present invention.

The structure of the front side (the side facing away from the dial of the bottomplate) of the movement is hereinafter described schematically. Referring to FIGS. 3–6, in the calendar mechanism-equipped timepiece of the present invention, the movement 100 has a bottom plate (or movement plate or main plate) 102 constituting a base plate of the movement 100. A stem 310 is rotatably mounted in a stem guide hole in the bottom plate 102. A dial 104 (indicated by phantom lines in FIGS. 3 and 4) is mounted to the movement 100. Referring to FIGS. 5 and 6, an escapement regulator and a front train wheel are disposed on the "front side" of the movement 100. The escapement regulator includes a balance with hairspring 340, an escape wheel 330, and a pallet fork 342. The front train wheel includes a fourth wheel & pinion 328, a third wheel & pinion 326, a second wheel & pinion 325, and a barrel 320. A switching device including a setting lever, a yoke, a yoke spring, and a yoke holder is disposed on the "rear side" of the movement 100. Also disposed on the "front side" of the movement 100 are a barrel bridge 360 supporting an upper shaft portion of the barrel 320 and an upper shaft portion of the second wheel & pinion 325 such that they can rotate, a train wheel bridge 362 supporting an upper shaft portion of the third wheel & pinion 326, an upper shaft portion of the fourth wheel & pinion 328, and an upper shaft portion of the escape wheel 330 such that they can rotate, a pallet bridge 364 supporting an upper shaft portion of the pallet fork 342 such that it can rotate, and a balance bridge 366 supporting an upper shaft portion of the balance with hairspring 340 such that it can rotate.

(1-2) Automatic Winding Mechanism

The structure of the automatic winding mechanism is next described. Referring to FIGS. 3–6, the automatic winding mechanism has a rotor 210, a first intermediate wheel 212 rotated based on rotation of the rotor 210, a second intermediate wheel 216 rotated based on rotation of the first intermediate wheel 212, a switching transfer wheel 220 rotated in one direction based on rotations of the first intermediate wheel 212 and second intermediate wheel 216, a first transfer wheel 250 rotated based on rotation of the switching transfer wheel 220, a second transfer wheel 252 rotated based on rotation of the first transfer wheel 250, and a third-transfer wheel 254 rotated based on rotation of the second transfer wheel 252. The rotor 210 includes an inner ring 210*a* fixedly mounted to the train wheel bridge 362, a plurality of balls 210*b*, an outer ring 210*c*, a rotor pinion 210*d* mounted integrally with the outer ring 210*c*, a rotor body 210*e* fixedly mounted to the outer ring 210*c*, and a rotor weight 210*f* fixedly mounted to the rotor body 210*e*. The outer ring 210*c* is designed to be rotatable relative to the inner ring 210*a* via the balls 210*b*. The first intermediate wheel 212 includes a first intermediate gear and a first intermediate pinion. The first intermediate wheel 212 is mounted to be rotatable relative to a first intermediate wheel pinion mounted to the bottom plate 102. The rotor pinion 210*d* is designed to mesh with the first intermediate gear. The second intermediate wheel 216 includes a second intermediate gear. The second intermediate gear is designed to mesh with the first intermediate pinion. An upper shaft portion of the second intermediate wheel 216 and an upper shaft portion of the switching transfer wheel 220 are mounted to be rotatable relative to the train wheel bridge 362. A lower shaft portion of the second intermediate wheel 216 and a lower shaft portion of the switching transfer wheel 220 are mounted to be rotatable relative to the bottom plate 102.

The first transfer wheel 250 includes a first transfer gear and a first transfer pinion. The second transfer wheel 252 includes a second transfer gear. The first transfer pinion is designed to mesh with the second transfer gear. The third transfer wheel 254 includes a third transfer gear and a third transfer pinion. The second transfer gear is designed to mesh with the first transfer pinion and with the third transfer gear. An upper shaft portion of the first transfer wheel 250 and an upper shaft portion of the second transfer wheel 252 are mounted to be rotatable relative to the automatic winding train wheel bridge (transfer bridge) 270. A lower shaft portion of the first transfer wheel 250 and a lower shaft portion of the second transfer wheel 252 are mounted to be rotatable relative to the barrel bridge 360. The third transfer wheel 254 is mounted to be rotatable relative to a third transfer wheel pin mounted to the barrel bridge 360. The third transfer pinion is designed to mesh with a ratchet wheel 316. The switching transfer wheel 220 includes a switching transfer pinion. In this automatic winding mechanism, the direction of rotation of the switching transfer pinion is constant irrespective of the direction of rotation of the rotor 210. Therefore, based on the rotation of the switching transfer pinion, the ratchet wheel 316 can be rotated only in one direction via rotations of the first transfer wheel 250, second transfer wheel 252, and third transfer wheel 254. The spring within the barrel 320 can be wound up only in one direction by rotation of the ratchet wheel 316.

(1-3) Escapement Regulator and Front Train Wheel

The structures of the escapement regulator and front train wheel are next described. The position of the stem 310 in the axial direction is determined by a switching device (described later). When the stem 310 is rotated under conditions where the stem 310 is in a first winding position (zeroth stage) closest to the inside of the movement 100 along the direction of axis of rotation, a winding pinion 312 is rotated via rotation of a clutch wheel 311 (see FIG. 2). A crown wheel 313 is designed to be rotated by rotation of the winding pinion 312. A transfer crown wheel 314 is designed to be rotated by rotation of the crown wheel 313. A ratchet sliding wheel 315 is designed to be rotated by rotation of the transfer crown wheel 314. The ratchet wheel 316 is rotated by rotation of the ratchet sliding wheel 315. The barrel 320 has a barrel gear 320*d*, a barrel arbor, and a spring. The spring accommodated in the barrel 320 is designed to be wound up by rotation of the ratchet wheel 316.

The second wheel & pinion 325 is designed to be rotated by rotation of the barrel 320. The second wheel & pinion 325 includes a center gear 325*a* and a center pinion. The barrel gear 320*d* is designed to mesh with the center pinion. The third wheel & pinion 326 is designed to be rotated by rotation of the second wheel & pinion 325. The third wheel & pinion 326 includes a third gear and a third pinion. The fourth wheel & pinion 328 is designed to be rotated once per minute by rotation of the third wheel & pinion 326. The fourth wheel & pinion 328 includes a fourth gear and a fourth pinion. The third gear is designed to mesh with the fourth pinion. The escape wheel 330 is designed to be rotated under control of the pallet fork 342 by rotation of the fourth wheel & pinion 328. The escape wheel 330 includes an escape gear and an escape pinion. The fourth gear is designed to mesh with the escape pinion. The barrel 320, second wheel & pinion 325, third wheel & pinion 326, and fourth wheel & pinion 328 together constitute a front train wheel. The escapement regulator for controlling the rotation of the front train wheel includes the balance with hairspring 340, escape wheel 330, and pallet fork 342. That is, the escape wheel 330 forms the pallet fork 342. The balance with hairspring 340 forms the escapement regulator. The balance with hairspring 340 includes a balance staff, a balance wheel 340*b*, and a hairspring 340*c*. The hairspring 340*c* is a thin leaf spring in the form of a spiral (helical) spring having plural turns. The balance with hairspring 340 is supported so as to be rotatable relative to the bottom plate 102 and relative to the balance bridge 366.

The barrel 320 and the second wheel & pinion 325 are supported to be rotatable relative to the bottom plate 102 and relative to the barrel bridge 360. That is, an upper shaft portion of the barrel 320, an upper shaft portion of the second wheel & pinion 325, and an upper shaft portion of the escape wheel 330 are supported to be rotatable relative to the train wheel bridge 362. Also, a lower shaft portion of the barrel 320 and a lower shaft portion of the second wheel & pinion 325 are supported to be rotatable relative to the bottom plate 102. The third wheel & pinion 326, fourth wheel & pinion 328, and escape wheel 330 are supported to be rotatable relative to the bottom plate 102 and the train wheel bridge 362. That is, an upper shaft portion of the third wheel & pinion 326, an upper shaft portion of the fourth wheel & pinion 328, and an upper shaft portion of the escape wheel 330 are supported to be rotatable relative to the train wheel bridge 362. A lower shaft portion of the third wheel & pinion 326 and a lower shaft portion of the escape wheel 330 are supported to be rotatable relative to the bottom plate 102. A lower shaft portion of the fourth wheel & pinion 328 is supported rotatably in the center hole of a center pipe 102*j* fixed to the bottom plate 102. The pallet fork 342 is supported to be rotatable relative to the bottom plate 102 and relative to the pallet bridge 364. An upper shaft portion of the pallet fork 342 is supported to be rotatable relative to the pallet bridge 364. A lower shaft portion of the pallet fork 342 is supported to be rotatable relative to the bottom plate 102. The fourth wheel & pinion 328 is rotated once per minute by rotation of the second wheel & pinion 325 via rotation of the third wheel & pinion 326. A second hand 358 attached to the fourth wheel & pinion 328 displays "seconds".

(1-4) Switching Mechanism, Rear Train Wheel, and Hand Resetting Mechanism

Figure 2:
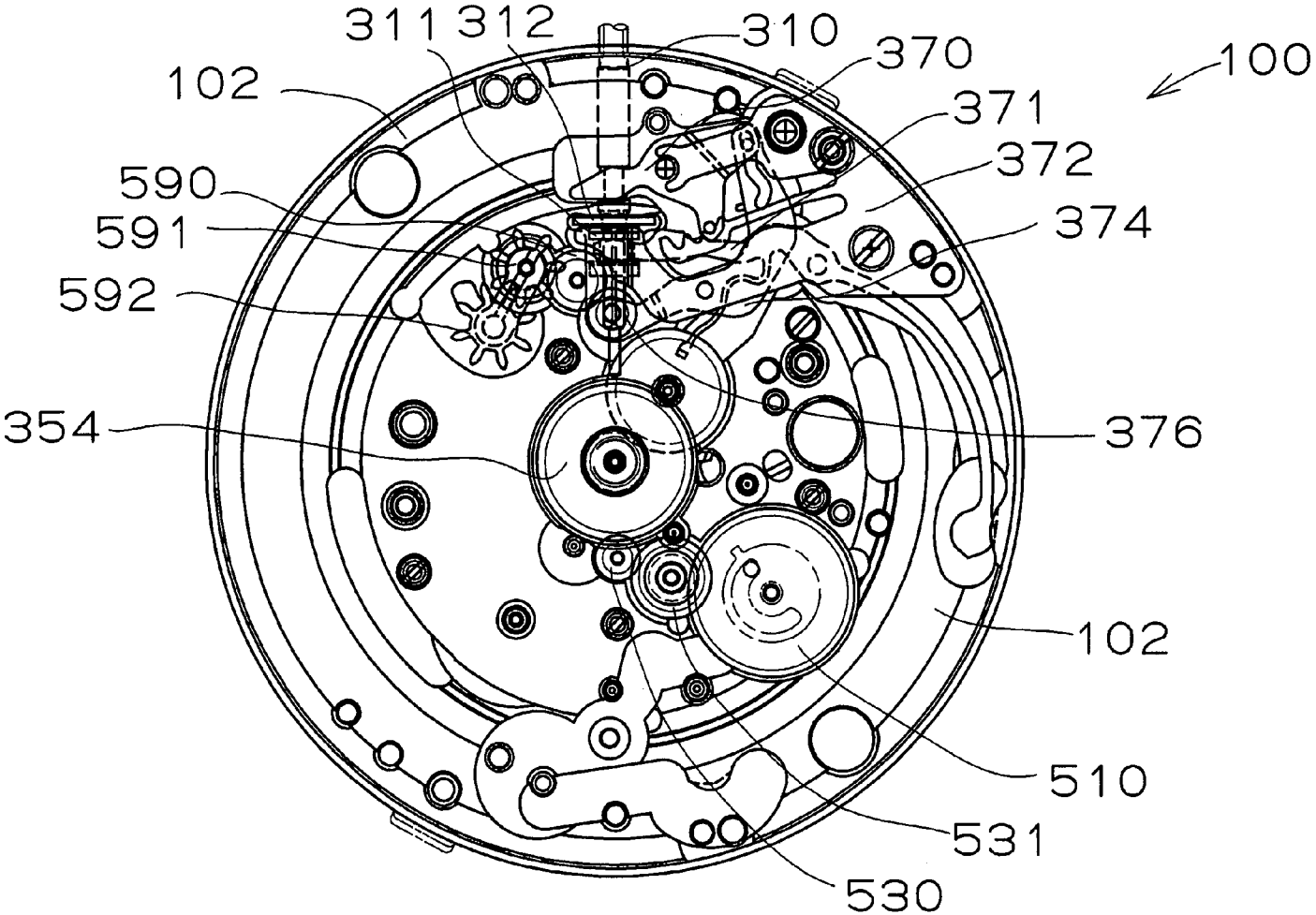
FIG. 2 is a schematic plan view showing a structure when the movement from which the auxiliary plate has been removed is viewed from the dial side in the first embodiment of the calendar mechanism-equipped timepiece of the present invention.
Figure 3:
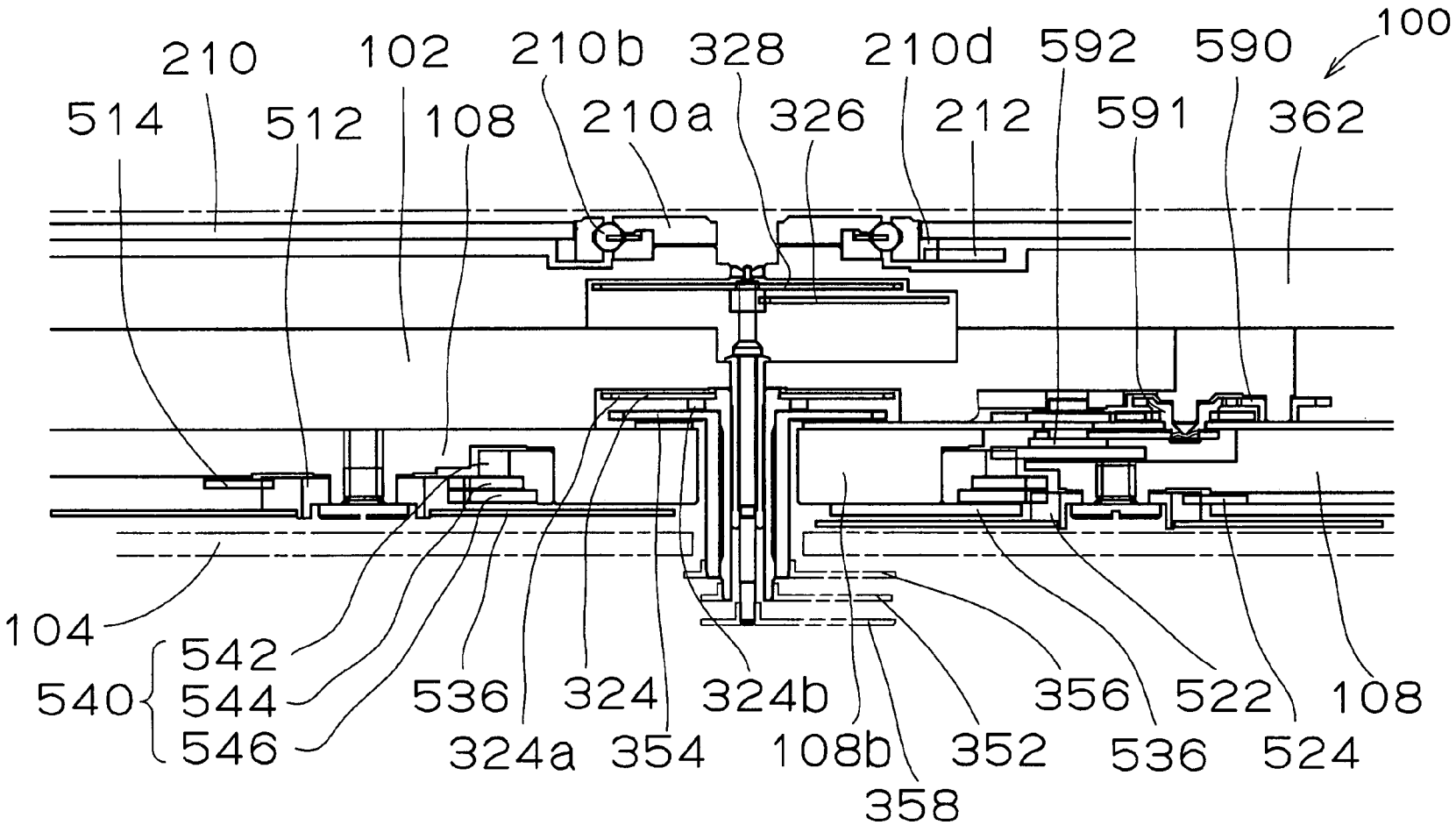
FIG. 3 is a fragmentary cross section showing portions of first date indicator, second day indicator, and program gear in the first embodiment of the calendar mechanism-equipped timepiece of the present invention.

The structures of the switching mechanism and hand resetting mechanism are described below. Referring to FIGS. 2 and 3, the switching mechanism including a setting lever 370, a yoke 371, and a yoke holder 372 is disposed on the "rear side" of the movement 100. The switching device may also be placed on the "front side" of the movement 100. The clutch wheel 311 is so arranged that it has an axis of rotation identical with the axis of rotation of the stem 310. When the stem 310 is in the zeroth, first, and second stages, the clutch wheel 311 is rotated based on rotation of the stem 310. A setting wheel 376 is disposed to be rotatable relative to a setting wheel operating lever 374.

Figure 4:
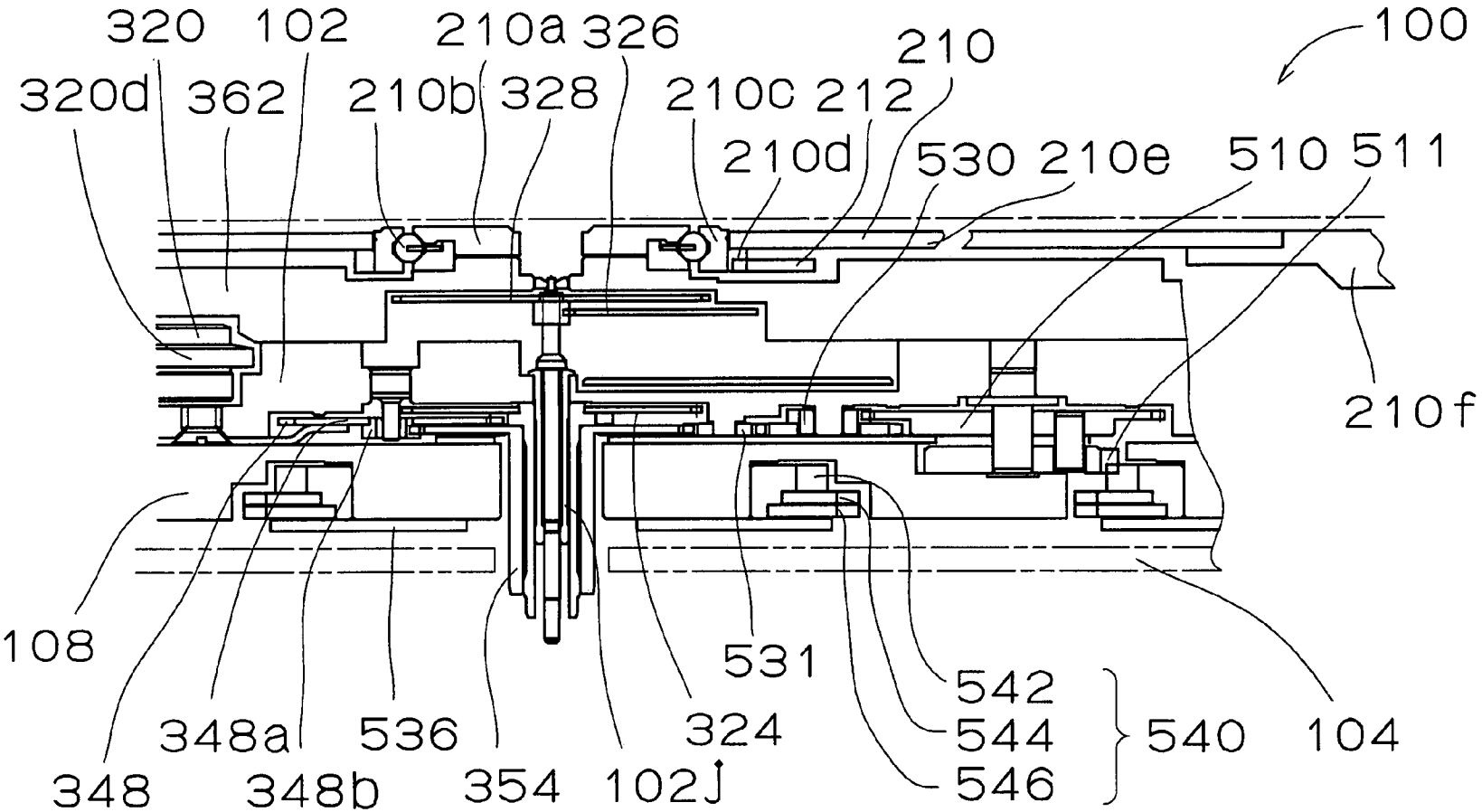
FIG. 4 is a fragmentary cross section showing portions of program gear and date indicator driving wheels in the first embodiment of the calendar mechanism-equipped timepiece of the present invention.

Referring to FIGS. 2–4, an auxiliary plate 108 is disposed on the side of the bottom plate 102 where the dial 104 is present. A center wheel & pinion 324 includes a minute gear 324*a* and a cannon pinion 324*b*. The minute gear 324*a* is designed to mesh with a third pinion 326*b*. The minute gear 324*a* and cannon pinion 324*b* are designed to rotate as a unit. The minute gear 324*a* is located between the bottom plate 102 and the auxiliary plate 108. The cannon pinion 324*b* and minute gear 324*a* are equipped with a slip mechanism permitting the cannon pinion 324*b* to slip relative to the minute gear 324*a*. A minute wheel & pinion 348 is designed to be rotated by rotation of the third wheel & pinion 326 via rotation of the center wheel & pinion 324. The minute wheel & pinion 348 includes a minute gear 348*a* and a minute pinion 348*b*. The minute wheel & pinion 348 is positioned between the bottomplate 102 and the auxiliary plate 108. The cannon pinion 324*b* is designed to mesh with the minute gear 348*a*. An hour wheel 354 is designed to mesh with the minute pinion 348*b*. The tooth portions of the hour wheel 354 are positioned between the bottom plate 102 and the auxiliary plate 108.

The hour wheel 354 is designed to be rotated once every 12 hours by rotation of the minute wheel & pinion 348. The center wheel & pinion 324, minute wheel & pinion 348, and hour wheel 354 together constitute a rear train wheel. The center wheel & pinion 324 is rotated once every hour by rotation of the barrel 320 via rotations of the second wheel & pinion 325 and third wheel & pinion 326. The minute hand 352 attached to the cannon pinion 324*b* of the center wheel & pinion 324 displays "minutes". Based on rotation of the center wheel & pinion 324, the hour wheel 354 is rotated once every 12 hours via rotation of the minute wheel & pinion 348. The hour hand 356 attached to the hour wheel 354 displays "hours". When the stem 310 is pulled out to the second stage, the setting wheel operating lever 374 rotates. When the stem 310 is rotated while it is in the third stem position (second stage), the minute wheel & pinion 348 can be rotated via rotations of the clutch wheel 311 and setting wheel 376. When the minute wheel & pinion 348 is rotated under the condition where the stem 310 is in the first stage, the cannon pinion 324*b* and the hour wheel 354 can be rotated and so the time of the timepiece can be corrected. Under this condition, the slip mechanism mounted on the cannon pinion 324*b* and minute gear 324*a* permits the cannon pinion 324*b* to slip relative to the minute gear 324*a*.

(1-5) Structure of Date Indicator Feeding Mechanism

The structure of the date indicator feeding mechanism is described below. Referring to FIGS. 1–4, the date indicator feeding mechanism includes a first date indicator intermediate driving wheel 530, a second date indicator intermediate driving wheel 531, a date indicator driving wheel 510, a date indicator driving pawl 511, a program wheel 540, and a program date indicator jumper 534. The first date indicator intermediate driving wheel 530 is mounted to be rotatable relative to a first date indicator intermediate driving wheel pin mounted to the bottom plate 102. The second date indicator intermediate driving wheel 531 is mounted to be rotatable relative to a second date indicator intermediate driving wheel pin mounted to the bottom plate 102. The date indicator driving wheel 510 and date indicator driving pawl 511 are mounted to be rotatable relative to a pin mounted to the bottom plate 102. The tooth portions of the hour wheel 354 mesh with the tooth portions of the first date indicator intermediate driving wheel 530. The tooth portions of the first date indicator intermediate driving wheel 530 mesh with the tooth portions of the second date indicator intermediate driving wheel 531. The pinion portion of the second date indicator intermediate driving wheel 531 meshes with the tooth portions of a date indicator driving gear 510*c*. The date indicator driving wheel 510 is designed to be rotated once every 24 hours by rotation of the hour wheel 354 via rotations of the first date indicator intermediate driving wheel 530 and second date indicator intermediate driving wheel 531. The date indicator driving pawl 511 is designed to be rotated based on rotation of the date indicator driving wheel 510. The first date indicator intermediate driving wheel 530 and the second date indicator intermediate driving wheel 531 are positioned between the bottom plate 102 and the auxiliary plate 108. The date indicator driving wheel 510 is positioned between the bottom plate 102 and the auxiliary plate 108. Preferably, the center of rotation of the date indicator driving wheel 510 is disposed between the "7 o'clock direction" and the "8 o'clock direction" on the dial.

Referring to FIGS. 1–4 and 9, the center hole 540*h* in the program wheel 540 is mounted to be rotatable relative to the outer periphery of a program gear guide shaft portion 108*b* mounted to the auxiliary plate 108. A program gear clamp 536 is positioned on the side of the auxiliary plate 108 where the dial 104 is present. The program wheel 540 is disposed between the auxiliary plate 108 and the program gear clamp 536. The center axis of rotation of the hour wheel 354 and center wheel & pinion 324 constituting a time display wheel is located inside the center hole 540*h* of the program wheel 540 under the condition where the hour wheel 354 and center wheel & pinion 324 constituting the time display wheel are rotatable. Preferably, the center axis of rotation of the hour wheel 354 and center wheel & pinion 324 constituting the time display wheel is coincident with the center axis of rotation of the program wheel 540. Because of this structure, the area occupied by the drive mechanism that drives the first date indicator 512 and the second date indicator 522 in the calendar mechanism-equipped timepiece can be reduced.

Referring to FIGS. 1–4 and 9–11, the program wheel 540 includes a program date indicator 542 designed to be rotated by rotation of the date indicator driving pawl 511, a first program gear 544 designed to be capable of rotating as a unit with the program date indicator 542 and of rotating the first date indicator 512 intermittently, and a second program gear 546 designed to be capable of rotating as a unit with the program date indicator 542 and of rotating the second date indicator 522 intermittently. The program date indicator 542, the first program gear 544, and the second program gear 546 can be fabricated from laminar structure. The program date indicator 542 is disposed on a side closer to the bottom plate 102. The second program gear 546 is disposed on a side closer to the dial 104. The first program gear 544 is positioned between the program date indicator 542 and the second program gear 546. In the program wheel 540 shown in FIGS. 1 and 13–16, a trapezoidal portion that is colored totally black indicates portions in which tooth portions are present in both the first program gear 544 and second program gear 546. A trapezoidal portion that is not colored totally black indicates portions in which tooth portions are present only in the first program gear 544.

The program date indicator 542 has 31 tooth portions formed such that they are angularly regularly spaced from each other. The angular spacing between the tooth portions of the program date indicator 542 is 360/31 degrees. When the center axis of rotation of the hour wheel 354 and center wheel & pinion 324 constituting the time display wheel is made coincident with the center axis of rotation of the program wheel 540, the program date indicator 542 can be brought into the center of the movement 100. The dimension of the outside diameter of the program date indicator 542 can be made large. Therefore, some latitude is offered in arranging the calendar correction mechanism. The module of the gear constituting the calendar correction mechanism can be made large. Accordingly, large latitude is offered in designing the calendar correction mechanism of the calendar mechanism-equipped timepiece of the present invention.

Figure 10:
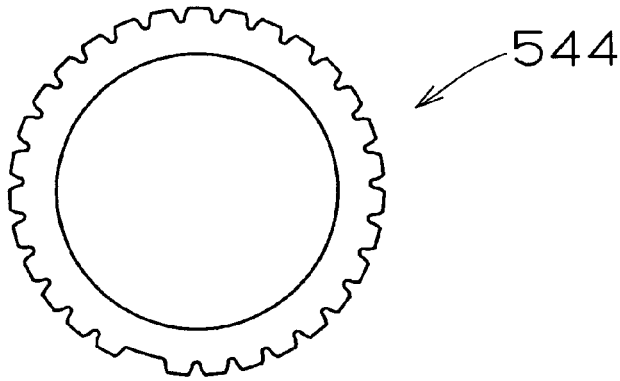
FIG. 10 is a plan view showing a first program gear in the first embodiment of the calendar mechanism-equipped timepiece of the present invention.
Figure 11:
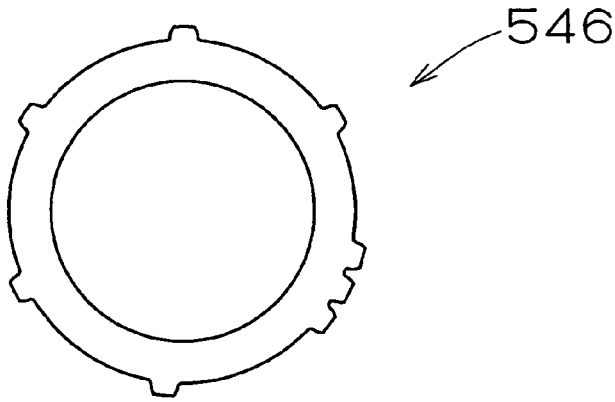
FIG. 11 is a plan view showing a second program gear in the first embodiment of the calendar mechanism-equipped timepiece of the present invention.

Referring to FIG. 10, the first program gear 544 has 30 tooth portions which are formed such that they are angularly regularly spaced from each other. The angular spacing between the tooth portions of the first program gear 544 is 360/31 degrees at 29 locations and is 2*360/31 degrees only at one location. Referring to FIG. 11, the second program gear 546 has 8 tooth portions. The angular spaces between the tooth portions of the second program gear 546 are 5*360/30 degrees, 5*360/30 degrees, 5*360/30 degrees, 5*360/30 degrees, 5*360/30 degrees, 4*360/30 degrees, 1*360/30 degrees, and 1*360/30 degrees in this order.

Figure 1:
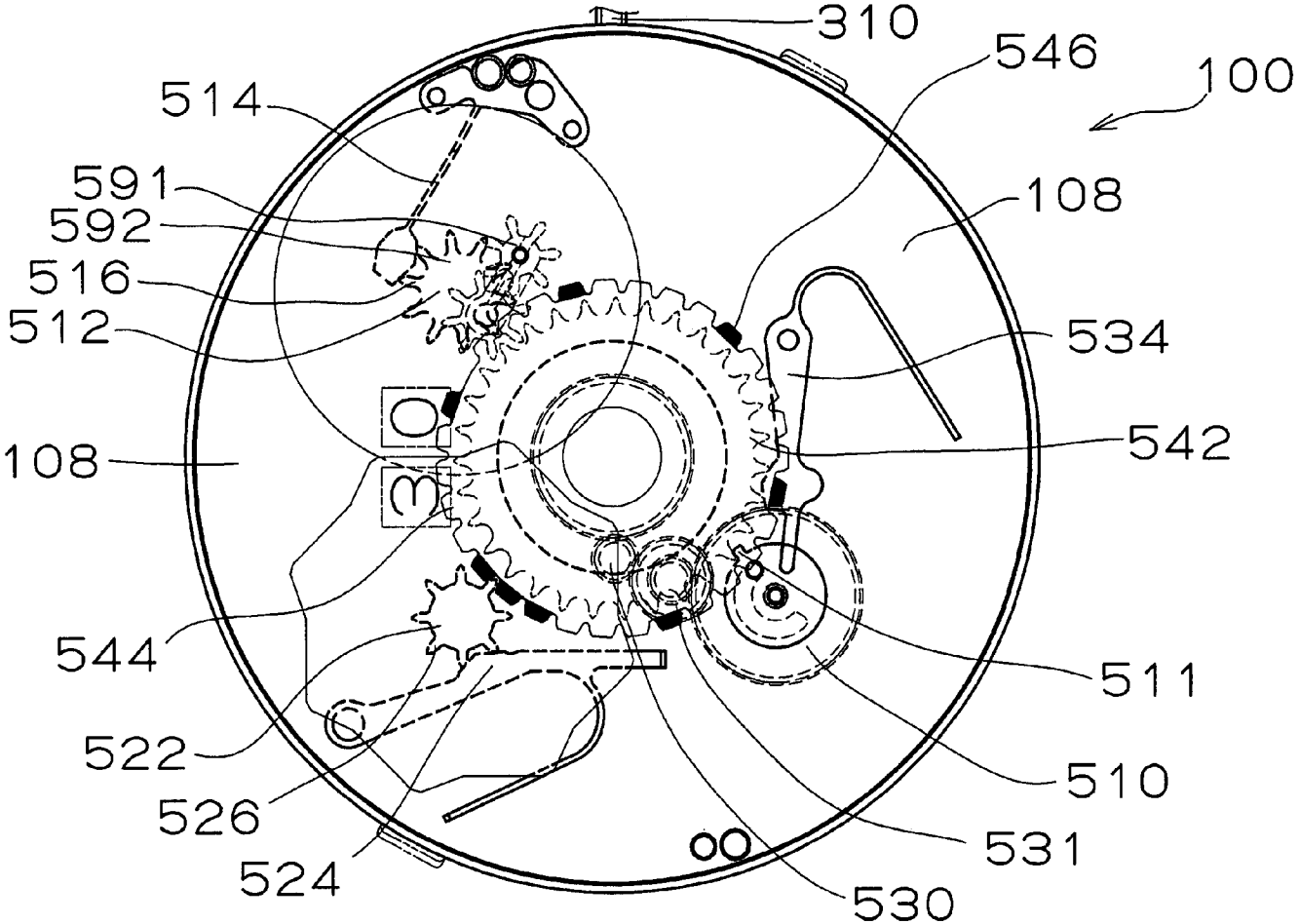
FIG. 1 is a schematic plan view showing the arrangement and interrelations of first date indicator, second date indicator, and program gear when a movement is viewed from the dial side in a first embodiment of a calendar mechanism-equipped timepiece of the present invention.
Figure 7:
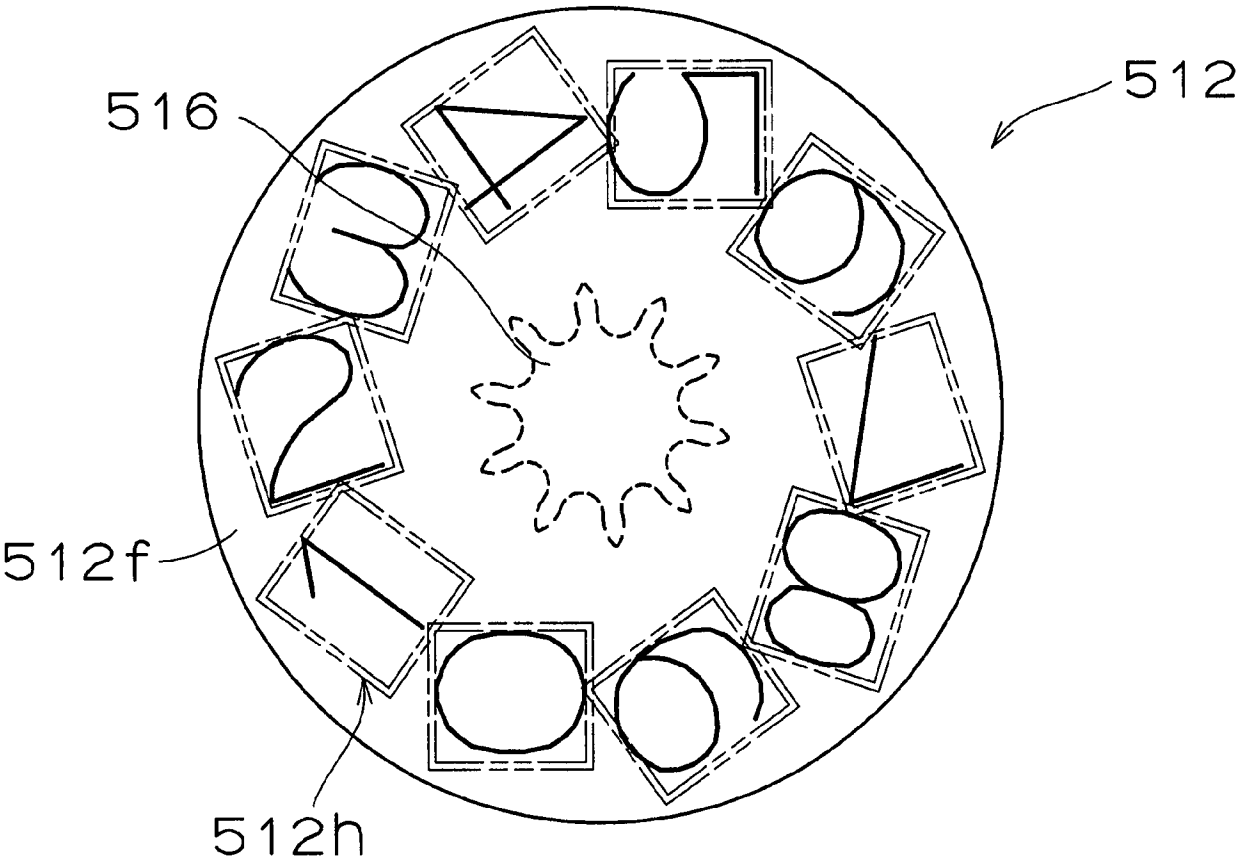
FIG. 7 is a plan view showing a first date indicator in the first embodiment of the calendar mechanism-equipped timepiece of the present invention.
Figure 8:
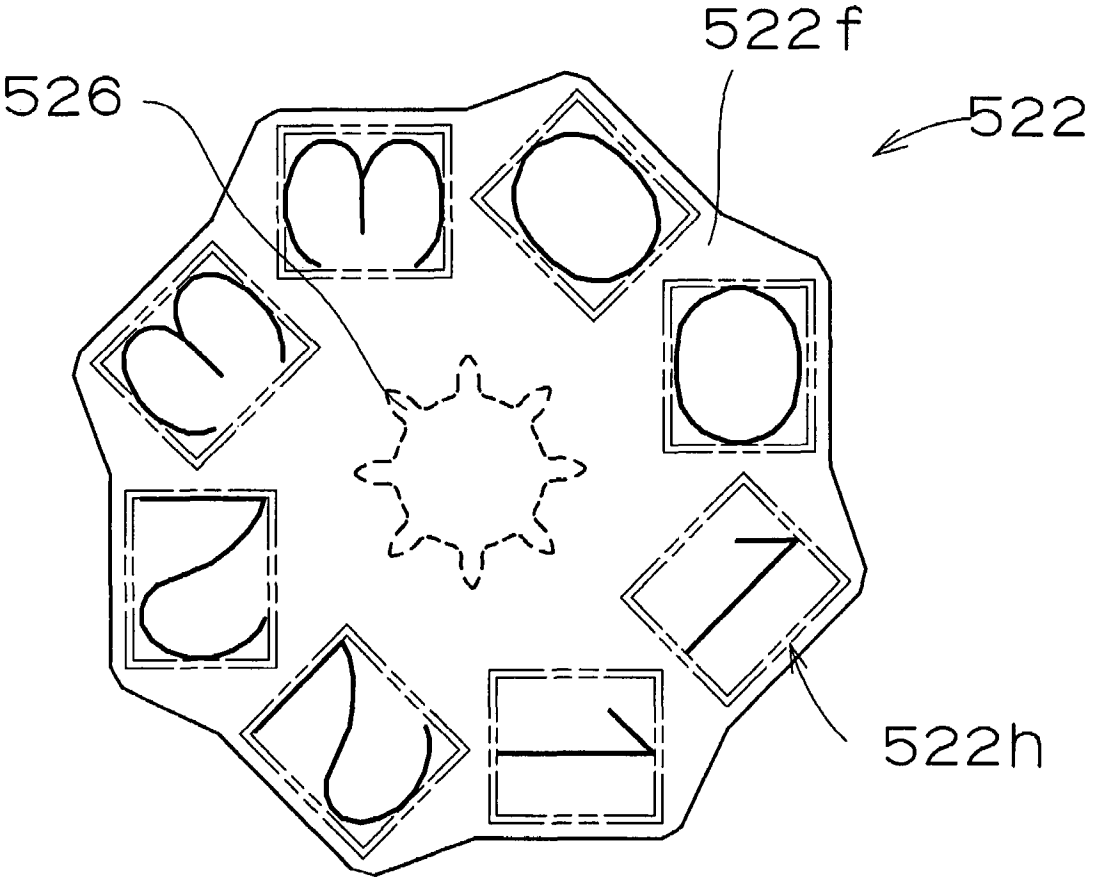
FIG. 8 is a plan view showing a second date indicator in the first embodiment of the calendar mechanism-equipped timepiece of the present invention.
Figure 9:
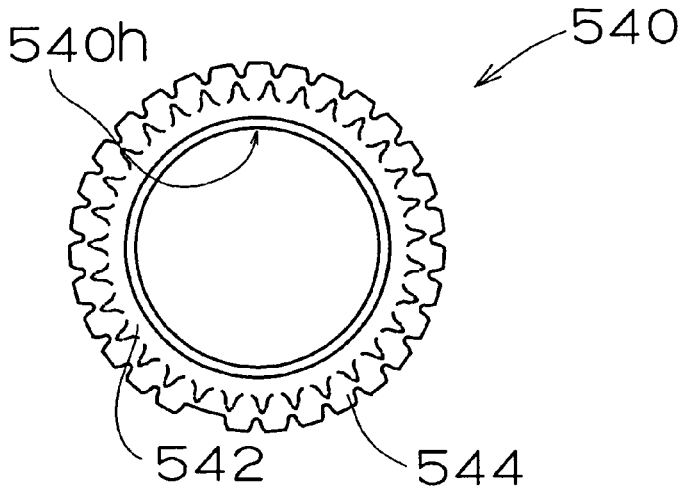
FIG. 9 is a plan view showing a program gear in the first embodiment of the calendar mechanism-equipped timepiece of the present invention.

Referring to FIG. 7, the first date indicator 512 is mounted to display the ones digit of the date. Referring to FIG. 8, the second date indicator 522 is mounted to display the tens digit of the date. Referring to FIG. 1, the center of rotation of the first date indicator 512 is preferably located between the "1 o'clock direction" and the "2 o'clock direction" on the dial. The center of rotation of the second date indicator 522 is preferably located between the "10 o'clock direction" and the "11 o'clock direction" on the dial. A straight line connecting the center of rotation of the first date indicator 512 and the center of rotation of the second date indicator 522 should be made parallel to the center axis of the stem 310. Because of this structure, a time piece equipped with a calendar mechanism and having large calendar display that is easy to see can be accomplished. The outside diameter of the first date indicator 512 should be set equal to the outside diameter of the second date indicator 522. A part of the outer contour of the first date indicator 512 should be made to overlap a part of the outer contour of the second date indicator 522. The first date indicator 512 and the second date indicator 522 are placed in position adjacently to each other. Information about the date or day can be displayed by means of one of first date characters provided on the first date indicator 512 and one of second date characters provided on the second date indicator 522.

Figure 13:
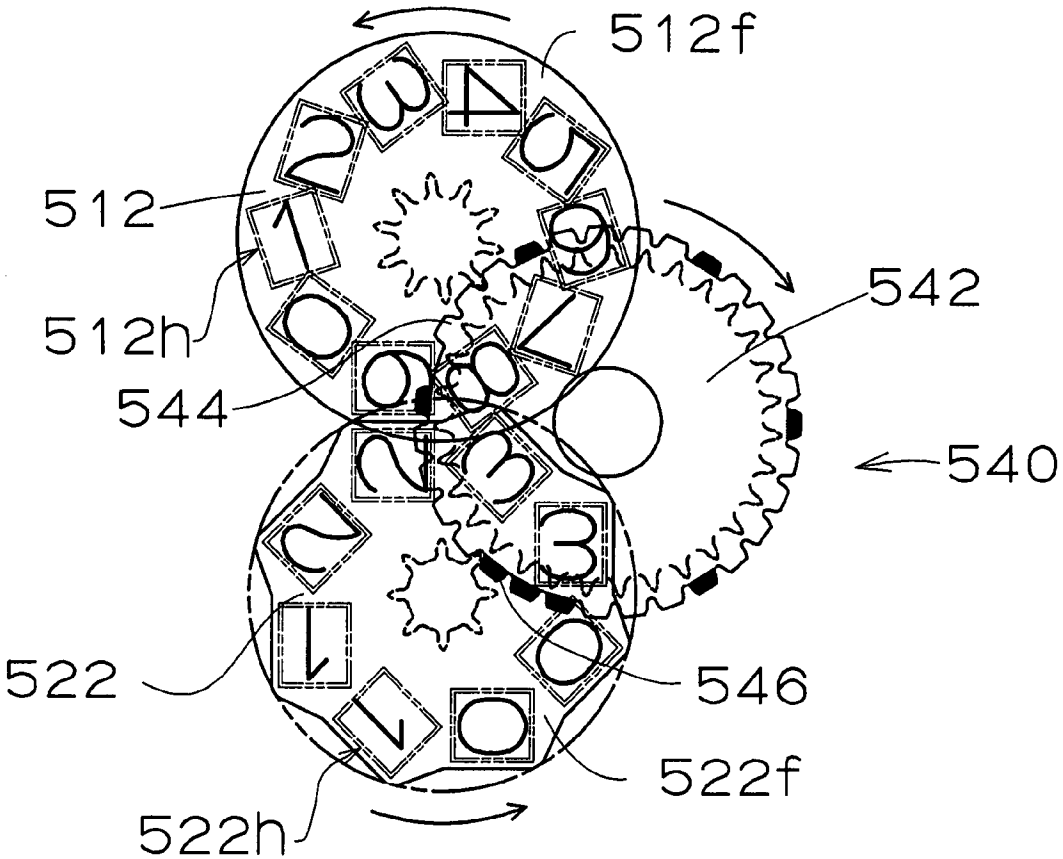
FIG. 13 is an enlarged fragmentary plan view showing portions of first date indicator, second date indicator, and program gear under conditions where "29th day (of the month)" is being displayed in the first embodiment of the calendar mechanism-equipped timepiece of the present invention.

FIG. 13 shows the state in which a date window is formed in the position of the 12 o'clock direction on the dial 104 in the calendar mechanism-equipped timepiece of the present invention. The first date indicator 512 shows "9" from this date window, while the second date indicator 522 shows "2", thus indicating that the date is "29th day (of the month)". Referring to FIGS. 1 and 3, the first date indicator 512 is rotatably mounted in the auxiliary plate 108. The first date indicator 512 has 10 tooth portions formed such that they are angularly regularly spaced from each other. The first date indicator jumper 514 is built in the auxiliary plate 108. The first date indicator jumper 514 for correcting or resetting the position of the first date indicator 512 in the direction of rotation includes a spring portion and a regulator portion mounted at the front end of the spring portion. The regulator portion of the first date indicator jumper 514 is so configured that it corrects or resets two of the tooth portions 516 of the first date indicator 512. The second date indicator 522 is rotatably built in the auxiliary plate 108. The second date indicator 522 has 8 tooth portions which are formed such that they are angularly regularly spaced from each other. A second date indicator jumper 524 for correcting or resetting the position of the second date indicator 522 in the direction of rotation is built in the auxiliary plate 108. The second date indicator jumper 524 includes a spring portion and a regulator portion mounted at the front end of the spring portion. The regulator portion of the second date indicator jumper 524 is designed so as to correct or reset two of the tooth portions 526 of the second date indicator 522.

Referring to FIG. 7, first day characters **512*h* consisting of 10 numerals are provided on the first date character display surface 512*f* of the first date indicator 512. The first day characters 512*h* include numerals "0", "1", "2", "3", "4", "5", "6", "7", "8", and "9" in this order in the peripheral direction. The 10 numerals forming the first day characters 512*h* are angularly regularly spaced from each other, i.e., at a spacing of (360/10) degrees, on the first date character display surface 512*f*. In the state shown in FIG. 13, "0" of the first date characters 512*h* is arranged in a date window 104*f* formed in the dial 104. When the first date indicator 512 rotates one pitch in the direction indicated by the arrow, "1" of the first day characters 512*h* is arranged in the date window 104*f*. Subsequently, when the first date indicator 512 rotates one pitch in the direction indicated by the arrow, a successive one of the first day characters 512*h* "2", "3", "4", "5", "6", "7", "8", "9", "0", and "1" is similarly arranged in this order in the date window 104*f***. Because of this structure, a calendar mechanism-equipped timepiece including a large calendar display which is easy to see can be accomplished.

Referring to FIG. 8, second date characters **522*h* consisting of 8 numerals are provided on a second date character display surface 522*f* of the second date indicator 522. The second date characters 522*h* include numerals "0", "0", "1", "1", "2", "2", "3", and "3"arrayed in this order in the peripheral direction. The 8 numerals constituting the second day characters 522*h* are angularly regularly spaced from each other, i.e., at a spacing of (360/8) degrees, on the second date character display surface 522*f*. In the state shown in FIG. 14, "3" of the second date characters 522*h* is arranged in the date window 104***f*. When the second date indicator 522 rotates one pitch in the direction indicated by the arrow, "3" of the second date characters 522*h* which is arranged next is arranged in the date window 104*f*. Subsequently, when the second date indicator 522 rotates one pitch in the direction indicated by the arrow, a successive one of "0", "0", "1", "1", "2", "2", and "3" of the second date characters 522*h* is similarly arranged in this order in the date window 104*f*. Alternatively, instead of providing a numeral "0" on the second date indicator 522, a blank portion (i.e., a plain portion having no numeral) may be formed in that position. Because of this structure, a calendar mechanism-equipped timepiece including a large calendar display which is easy to see can be accomplished.

Figure 14:
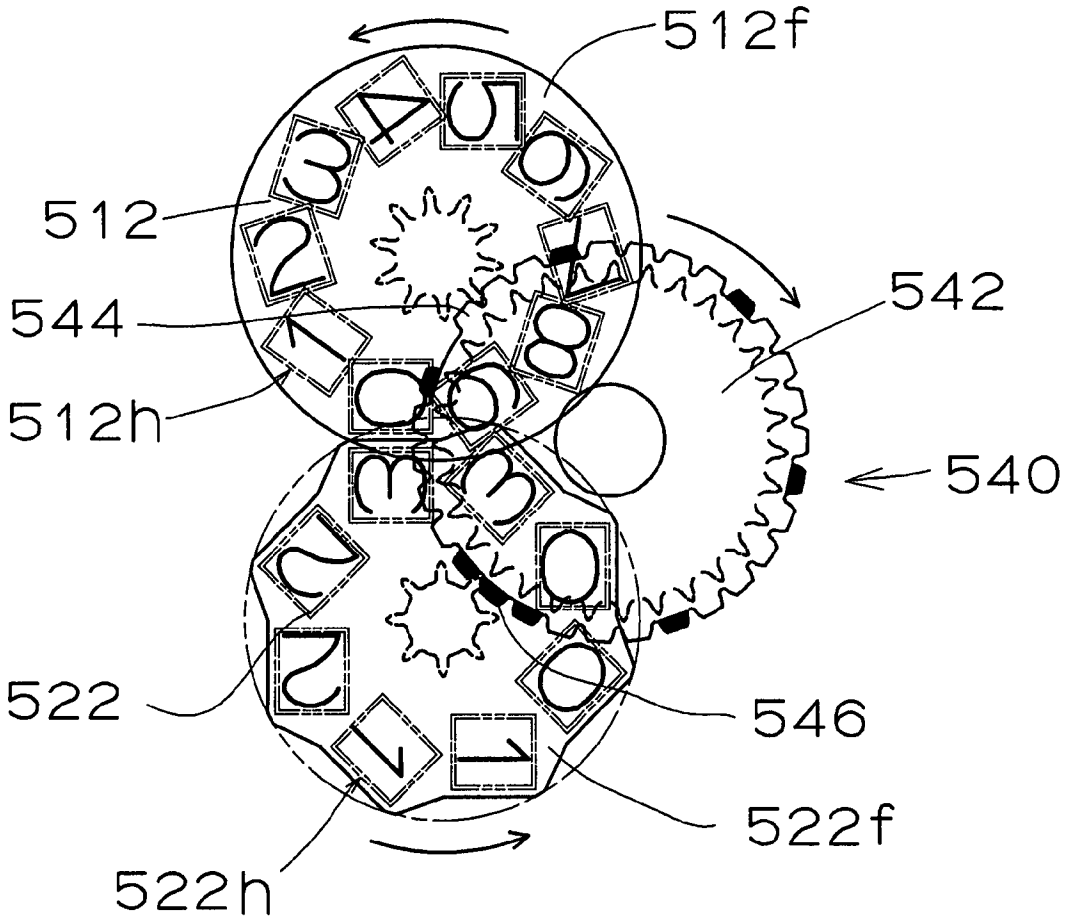
FIG. 14 is an enlarged fragmentary plan view showing portions of first date indicator, second date indicator, and program gear under conditions where "30th day (of the month)" is being displayed in the first embodiment of the calendar mechanism-equipped timepiece of the present invention.
Figure 17:
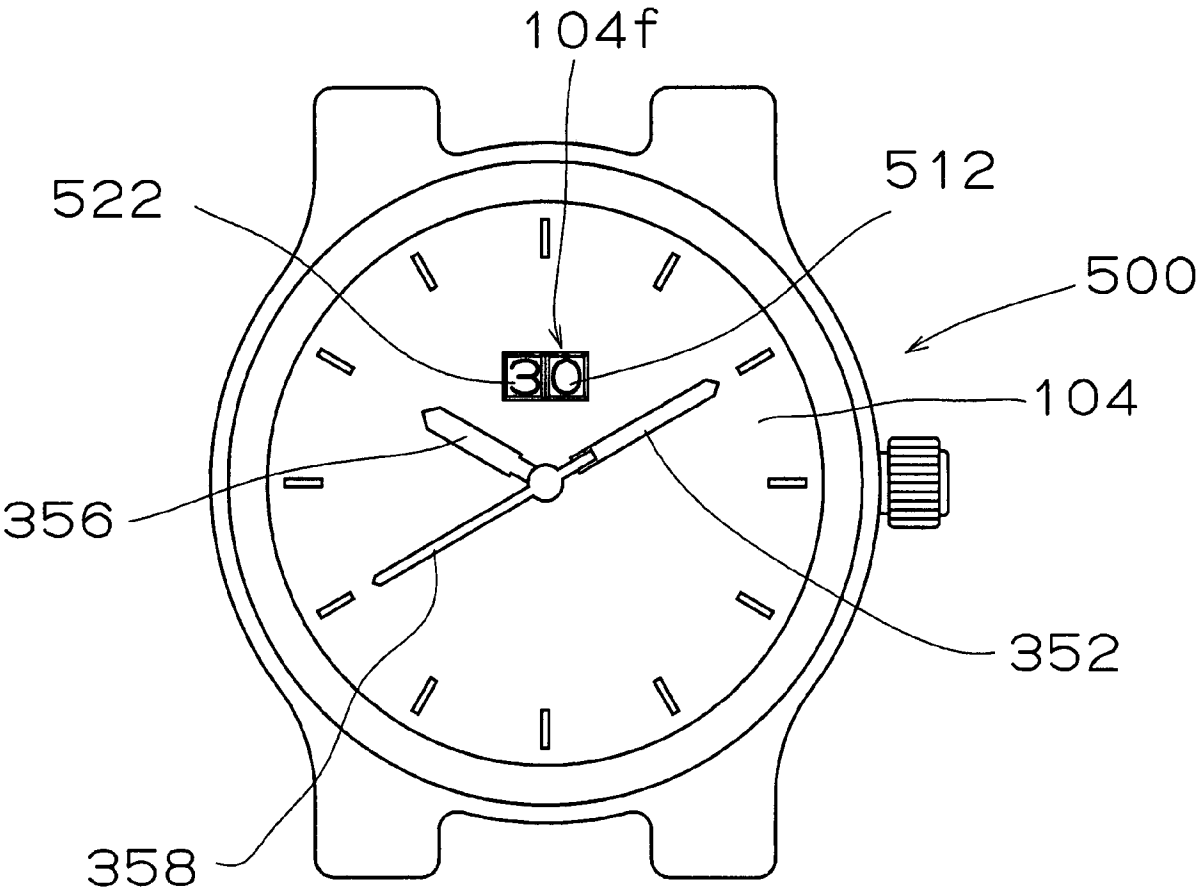
FIG. 17 is a plan view showing complete under the condition where "30th day" is being displayed with a configuration in which a date window is positioned in the 12 o'clock direction on the dial in the first embodiment of the calendar mechanism-equipped timepiece of the present invention.

In the state shown in FIG. 14, "3" of the second date characters 522*h* is arranged in the left portion of the date window 104*f* in the movement 100. Furthermore, "0" of the first date characters 512*h* is arranged in the left portion of the date window 104*f*. The second date character display surface 522*f* is arranged at a position closer to the dial 104 than the first date character display surface 512*f*. Referring to FIG. 17, in the completed calendar mechanism-equipped timepiece 500 of the present invention, the date window 104*f* is formed at the position of the 12 o'clock on the dial 104. In the completed product 500, "3" of the second date characters 522*h* on the second date indicator 522 is arranged in the left portion inside the date window 104*f* in the dial 104, and "0" of the first date characters 512*h* on the first date indicator 512 is arranged in the right portion inside the date window 104*f*. Accordingly, FIG. 17 shows the state in which "30th day (of the month)" is displayed on the completed product 500 by the second day characters 522*h* on the second date indicator 522 and the first date characters 512*h* on the first date indicator 512.

Referring to FIGS. 1–4 and 13, the date indicator driving wheel 510 is rotated by rotation of the hour wheel 354 via rotations of the first date indicator intermediate driving wheel 530 and the second date indicator intermediate driving wheel 531. The date indicator driving pawl 511 rotates the program wheel 540 an amount corresponding to one tooth in a clockwise direction only once per day. As the program wheel 540 rotates, the first program gear 544 rotates the first date indicator 512 an amount corresponding to one tooth in a counterclockwise direction, whereby, the date character displayed from the date window 104*g* can be varied from "9" to "0" by the first date indicator 512. Rotation of the first date indicator 512 corresponding to one tooth is corrected or reset by the first date indicator jumper 514. Simultaneously with rotation of the first date indicator 512 by the first program gear 544, the second program gear 546 rotates the second date indicator 522 an amount corresponding to one tooth in a counterclockwise direction. Thus, the date character displayed from the date window 104*g* can be varied from "2" to "3" by the second date indicator 522. The rotation of the second date indicator 522 corresponding to one tooth is corrected or adjusted by the second date indicator jumper 524. As shown in FIG. 14, "3" is displayed by the second day characters 522*h* on the second date indicator 522 by operation of the date feeding described above. The first date characters 512*h* on the first date indicator 512 display "0". The second date indicator 522 and the first date indicator 512 can display "30th day (of the month)" from the date window 104*g*. The operation for date feeding as described above may be completed when the hour hand 356 and the minute hand 352 display "12:00".

(1-6) Structure of Calendar Correction Mechanism

Referring to FIGS. 1–3, the calendar correction mechanism includes a first calendar correction wheel 590, a second calendar correction wheel 591, and a calendar correction wheel 592. The calendar correction wheel 592 is designed to be swung along a guide hole formed in the bottom plate 102. When the stem 310 is pulled out from the zeroth stage to the first stage, the setting wheel operating lever 374 is rotated based on rotation of the setting lever 370. The tooth portions of the setting wheel 376 can mesh with the tooth portions of the first calendar correction wheel 590. Furthermore, when the stem 310 is pulled out from the zeroth stage to the first stage, the yoke 371 is rotated based on rotation of the setting lever 370. The inner tooth portions of the clutch wheel 311 can mesh with the tooth portions of the setting wheel 376. When the stem 310 is rotated in the first direction under conditions where the stem 310 has been pulled out to the first stage, the clutch wheel 311 turns. The second calendar correction wheel 591 is rotated by rotations of the setting wheel 376 and the first calendar correction wheel 590. Rotation of the second calendar correction wheel 591 swings the calendar correction wheel 592 in a counterclockwise direction. The wheel 592 rotates to a position where the tooth portions of the calendar correction wheel 592 come into mesh with the tooth portions of the program date indicator 542 and the wheel comes to a stop. The calendar correction wheel 592 is rotated at that calendar correction position. When the calendar correction wheel 592 rotates in the calendar correction position, the calendar correction wheel 592 can rotate the program wheel 540 in a clockwise direction.

If the stem 310 is rotated in a second direction opposite to the first direction under conditions where the stem 310 has been pulled out to the first stage, the clutch wheel 311 turns. Rotations of the setting wheel 376 and the first calendar correction wheel 590 cause the second calendar correction wheel 591 to rotate. The rotation of the second calendar correction wheel 591 swings the calendar correction wheel 592 in a clockwise direction. The wheel 592 rotates to a position where the tooth portions of the calendar correction wheel 592 no longer mesh with the tooth portions of the program date indicator 542. Thus, the wheel stops at an idle position. In the case where the calendar correction wheel 592 rotates at the idle position, the program wheel 540 can be prevented from rotating. When the stem 310 is rotated in the first direction under conditions where the stem 310 has been pulled out to the first stage, the calendar correction wheel 592 is rotated via rotations of the clutch wheel 311, setting wheel 376, first calendar correction wheel 590, and second calendar correction wheel 591. Thus, the program wheel 540 is rotated an amount corresponding to one tooth in a clockwise direction. The first program gear 544 can rotate the first date indicator 512 an amount corresponding to one tooth in a counterclockwise direction. Simultaneously with rotation of the first date indicator 512 by the first program gear 544, the second program gear 546 can rotate the second date indicator 522 an amount corresponding to one tooth in a counterclockwise direction.

(1-7) Operation of Hands in Normal Motion

Operation of the hands of the calendar mechanism-equipped timepiece of the present invention when the hands are in normal motion are next described. Referring to FIGS. 3–6, 12, and 17, the spring (not shown) mounted in the barrel 320 constitutes the power source for the timepiece. Since the spring is unwound (released), the barrel gear 320*d* of the barrel 320 rotates in one direction. Time information is displayed by the hands including the hour hand, minute hand, and second hand via rotations of the front and rear train wheels. Rotation of the barrel gear 320*d* rotated by the power of the spring is controlled by the regulator, and escapement. The regulator includes the balance with hairspring 340. The escapement includes the pallet fork 342 and the escape wheel 330. The second wheel & pinion 325 is rotated by rotation of the barrel gear 320*d*. The third wheel & pinion 326 is rotated by rotation of the second wheel & pinion 325. The fourth wheel & pinion 328 is rotated once every minute by rotation of the third wheel & pinion 326. The rotational speed of the fourth wheel & pinion 328 is controlled by the escape wheel 330. The rotational speed of the escape wheel 330 is controlled by the pallet fork 342. Swinging motion of the pallet fork 342 is controlled by the balance with hairspring 340. The center wheel & pinion 324 is rotated once every hour by rotation of the third wheel & pinion 326. The minute hand 352 attached to the center wheel & pinion 324 displays "minutes". The second hand 358 attached to the fourth wheel & pinion 328 displays "seconds". The center of rotation of the fourth wheel & pinion 328 and the center of rotation of the center wheel & pinion 324 are brought to the same position. The minute wheel & pinion 348 is rotated by rotation of the center wheel & pinion 324. The hour wheel 354 is rotated once every 12 hours by rotation of the minute wheel & pinion 348. The hour hand 356 mounted to the hour wheel 354 displays "hours".

(1-8) Operation for Winding Up

The operation of the manual winding mechanism in the calendar mechanism-equipped timepiece of the present invention is described below. Referring to FIGS. 2, 5, and 6, the ratchet wheel 316 is supported such that it rotates as a unit with the barrel arbor of the barrel 320. The ratchet wheel 316 can rotate only in the same direction as the direction of rotation of the barrel 320. A click 318 constituting a member for correcting or resetting the rotation of the ratchet wheel is mounted in the barrel bridge 360 to restrict the rotation of the ratchet wheel 316 only in one direction. It is possible to prevent the ratchet wheel 316 from rotating in a direction opposite to the direction of rotation of the barrel 320 by means of the click 318. When the clutch wheel 311 is rotated in one direction under the condition where the stem 310 is in its zeroth stage, the winding pinion 312 rotates. The rotation of the winding pinion 312 rotates the ratchet wheel 316 in a clockwise direction via rotations of the crown wheel 313, the transfer crown wheel 314, and the ratchet sliding wheel 315. The spring can be wound by rotation of the ratchet wheel 316.

Next, in the calendar mechanism-equipped timepiece of the present invention, the operation of the automatic winding mechanism is described. Referring to FIGS. 3–6, in the automatic winding mechanism, the rotor 210 rotates. Also, the first intermediate wheel 212 is rotated based on the rotation of the rotor 210. The second intermediate wheel 216 is rotated based on the rotation of the first intermediate wheel 212. The switching transfer pinion of the switching transfer wheel 220 rotates only in one direction based on the rotations of the first intermediate wheel 212 and the second intermediate wheel 216. The ratchet wheel 316 can be rotated only in one direction based on the rotation of the switching transfer pinion via rotations of the first transfer wheel 250, second transfer wheel 252, and third transfer wheel 254. The spring inside the barrel 320 can be wound up only in one direction by rotation of the ratchet wheel 316.

(1-9) Operation for Correction of Hands

Next, in the calendar mechanism-equipped timepiece of the present invention, the operation in a case where the hands are corrected is described. When the stem 310 is pulled out to the second stage from the state shown in FIG. 2, the clutch wheel 311 is rotated based on rotation of the stem 310. That is, when the stem 310 is rotated under conditions where the stem 310 has been pulled out to the second stage, the setting wheel 376 is rotated based on rotation of the clutch wheel 311. The minute wheel & pinion 348 is rotated based on rotation of the setting wheel 376. Accordingly, "correction of the hands" can be made by rotating the stem 310 while the stem 310 is in the second stage. That is, when the stem 310 is in the second stage, the hour wheel 354 is rotated by rotating the stem 310. This corrects the contents of display of the "hours" displayed by the hour hand 356 attached to the hour wheel 354. At the same time, by rotating the center wheel & pinion 324, the contents of display of "minutes" displayed by the minute hand 352 attached to the center wheel & pinion 324 can be corrected.

(1-10) Operation of Calendar Feeding

Next, the operation of calendar feeding of the calendar mechanism-equipped timepiece of the present invention is described. Referring to FIG. 13, the state shown in FIG. 13 is that "2" of the second date characters 522*h* is disposed in the left portion in the date window 104*f* and that "9" of the first date characters 512*h* is disposed in the left portion in the date window 104*f*. Accordingly, in the state shown in FIG. 13, the second date character 522*h* on the second date indicator 522 and the first date character 512*h* on the first date indicator 512 display "29th day (of the month)" in the completed product 500.

Referring to FIGS. 1–4 and 13, the date indicator driving wheel 510 is rotated by rotation of the hour wheel 354 via rotations of the first date indicator intermediate driving wheel 530 and the second date indicator intermediate driving wheel 531. The date indicator driving pawl 511 rotates the program wheel 540 an amount corresponding to one tooth once every day in a clockwise direction. The first program gear 544 rotates the first date indicator 512 an amount corresponding to one tooth in a counterclockwise direction owing to rotation of the program wheel 540, thus varying the date character displayed from the date window 104*g* by the first date indicator 512 from "9" to "0". Simultaneously with rotation of the first date indicator 512 by the first program gear 544, the second program gear 546 rotates the second date indicator 522 an amount corresponding to one tooth in a counterclockwise direction, thus varying the date character displayed from the date window 104*g* by the second date indicator 522 from "2" to "3". Accordingly, as shown in FIG. 14, by the operation for date feeding as described above, the second date characters 522*h* on the second date indicator 522 display "3", and the first date characters 512*h* on the first date indicator 512 display "0". It is possible to display "30th day (of the month)" from the date window 104*g* by the second date indicator 522 and the first date indicator 512. The operation for date feeding as described above is completed when the hour hand 356 and the minute hand, 352 display "12:00".

Figure 15:
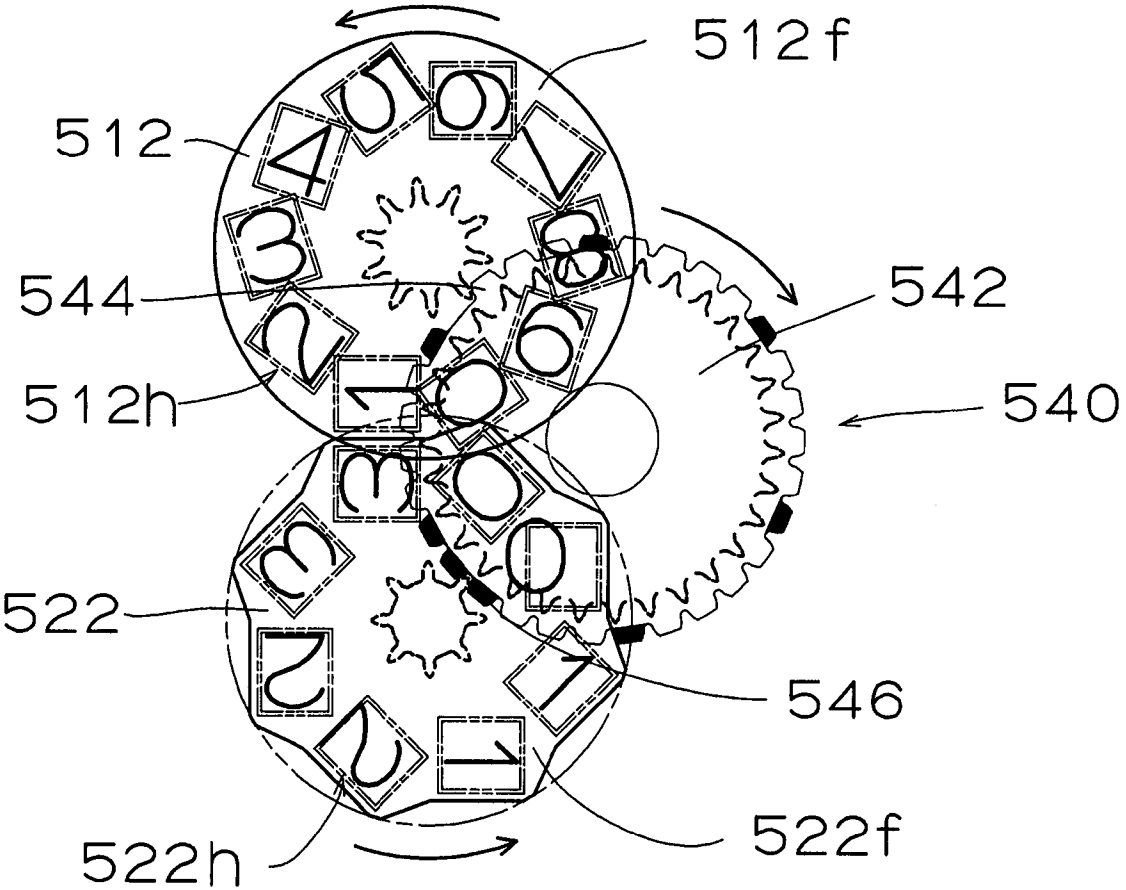
FIG. 15 is an enlarged fragmentary plan view showing portions of first date indicator, second date indicator, and program gear under conditions where "31st day (of the month)" is being displayed in the first embodiment of the calendar mechanism-equipped timepiece of the present invention.

Referring to FIGS. 1–4 and 14, by rotating the hour wheel 354 further, the date indicator driving wheel 510 is rotated via rotations of the first date indicator intermediate driving wheel 530 and the second date indicator intermediate driving wheel 531. The date indicator driving pawl 511 rotates the program wheel 540 an amount corresponding to one tooth once every day in a clockwise direction. Because the program wheel 540 is rotated, the first program gear 544 rotates the first date indicator 512 an amount corresponding to one tooth in a counterclockwise direction. This varies the date character displayed from the date window 104*g* by the date indicator 512 from "0" to "1". Simultaneously with rotation of the first date indicator 512 by the first program gear 544, the second program gear 546 rotates the second date indicator 522 an amount corresponding to one tooth in a counterclockwise direction. This varies the date character displayed from the date window 104*g* by the second date indicator 522 from "3" located next to "2" to "3" located ahead of "0". Accordingly, as shown in FIG. 15, because of the operation for date feeding as described above, the second date-characters 522*h* on the second date indicator 522 display "3". The first date characters 512*h* on the first date indicator 512 display "1". The second date indicator 522 and the first date indicator 512 can display "31st day (of the month)" from the date window 104*g*.

Figure 16:
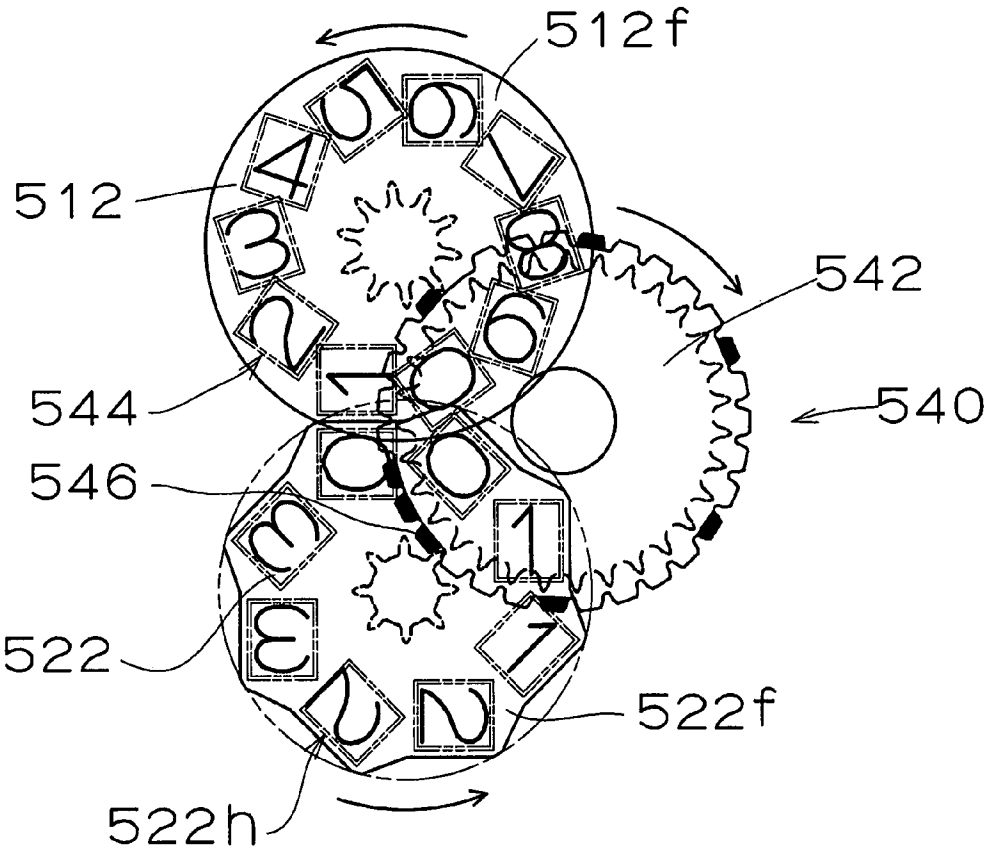
FIG. 16 is an enlarged fragmentary plan view showing portions of first date indicator, second date indicator, and program gear under conditions where "31st day (of the month)" is being displayed in the first embodiment of the calendar mechanism-equipped timepiece of the present invention.

Referring to FIGS. 1–4 and 15, further rotation of the hour wheel 354 causes the date indicator driving wheel 510 to rotate via rotations of the first date indicator intermediate driving wheel 530 and the second date indicator intermediate driving wheel 531. The date indicator driving pawl 511 rotates the program wheel 540 an amount corresponding to one tooth once every day in a clockwise direction. In the case where the program wheel 540 rotates, the first program gear 544 does not rotate the first date indicator 512. The date character displayed from the date window 104*g* by the first date indicator 512 remains "1". At this time, the second program gear 546 rotates the second date indicator 522 an amount corresponding to one tooth in a counterclockwise direction. This varies the date character displayed from the date window 104*g* by the second date indicator 522 from "3" to "0". Accordingly, as shown in FIG. 16, because of the operation for date feeding as described above, the second date characters 522*h* on the second date indicator 522 display "0". The first date characters 512*h* on the first date indicator 512 display "1". Thus, the second date indicator 522 and the first date indicator 512 can display "01st day" (i.e., "1st day") from the date window 104*g*.

Referring to FIGS. 1–4 and 16, further rotation of the hour wheel 354 causes the date indicator driving wheel 510 to rotate via rotations of the first date indicator intermediate driving wheel 530 and the second date indicator intermediate driving wheel 531. The date indicator driving pawl 511 rotates the program wheel 540 an amount corresponding to one tooth once every day in a clockwise direction. Because the program wheel 540 is rotated, the first program gear 544 rotates the first date indicator 512 an amount corresponding to one tooth in a counterclockwise direction. This varies the date character displayed from the date window 104*g* by the date indicator 512 from "1" to "2". When the first program gear 544 rotates the first date indicator 512, the second program gear 546 does not rotate the second date indicator 522. The date character displayed from the date window 104*g* by the second date indicator 522 remains "0". Accordingly, because of the operation for date feeding as described above, the second date characters 522*h* on the second date indicator 522 display "0". The first date characters 512*h* on the first date indicator 512 display "2". Thus, the second date indicator 522 and the first date indicator 512 can display "02nd day" (i.e., "2nd day") from the date window 104*g*.

Further rotation of the hour wheel 354 causes the first program gear 544 to rotate the first date indicator 512 an amount corresponding to one tooth in a counterclockwise direction. This varies the date character displayed from the date window 104*g* by the first date indicator 512 from "2" to "3". When the first program gear 544 rotates the first date indicator 512, the second program gear 546 does not rotate the second date indicator 522. The date character displayed from the date window 104*g* by the second date indicator 522 remains "0". Therefore, because of the operation for date feeding as described above, it is possible to display "03rd day" (i.e., "3rd day") from the date window 104*g* by the second date indicator 522 and the first date indicator 512.

Since the hour wheel 354 rotates further, the first program gear 544 rotates the first date indicator 512 an amount corresponding to one tooth in a counterclockwise direction. This varies the date character displayed from the date window 104*g* by the first date indicator 512 from "3" to "4". When the first program gear 544 rotates the first date indicator 512, the second program gear 546 does not rotate the second date indicator 522. The date character displayed from the date window 104*g* by the second date indicator 522 remains "0". Accordingly, because of the operation for date feeding as described above, it is possible to display "04th day" (i.e., "4th day") from the date window 104*g* by the second date indicator 522 and the first date indicator 512.

Since the hour wheel 354 rotates further, the first program gear 544 rotates the first date indicator 512 an amount corresponding to one tooth in a counterclockwise direction. This varies the date character displayed from the date window 104*g* by the first date indicator 512 from "4" to "5". At this time, the second program gear 546 rotates the second date indicator 522 an amount corresponding to one tooth in a counterclockwise direction. This varies the date character displayed from the date window 104*g* by the second date indicator 522 from "0" located next to "3" to "0" located ahead of "1". Therefore, because of the operation for date feeding as described above, it is possible to display "05th day" (i.e., "5th day") from the date window 104*g* by the second date indicator 522 and the first date indicator 512. Subsequently, in the calendar mechanism-equipped timepiece of the present invention, these operations are repeated every five days. It is possible to display from "01st day" to "31st day" from the date window 104*g* by the second date indicator 522 and the first date indicator 512.

(1-11) Operation for Correction of Date

In the calendar mechanism-equipped timepiece of the present invention, the operation in a case where a date correction is made is next described. Referring to FIGS. 1–3, when the stem 310 is rotated in a first direction under the condition where the stem 310 has been pulled out to the first stage, the clutch wheel 311 rotates. The second calendar correction wheel 591 rotates due to rotations of the setting wheel 376 and first calendar correction wheel 590. The calendar correction wheel 592 is swung in a counterclockwise direction due to rotation of the second calendar correction wheel 591. The wheel calendar correction 592 rotates to a position where its tooth portions mesh with the tooth portions of the program date indicator 542, and then the wheel 592 comes to a stop. The calendar correction wheel 592 rotates at that calendar correction position. When the calendar correction wheel 592 rotates at the calendar correction position, the program wheel 540 can be rotated in a clockwise direction by rotation of the calendar correction wheel 592.

Figure 12:
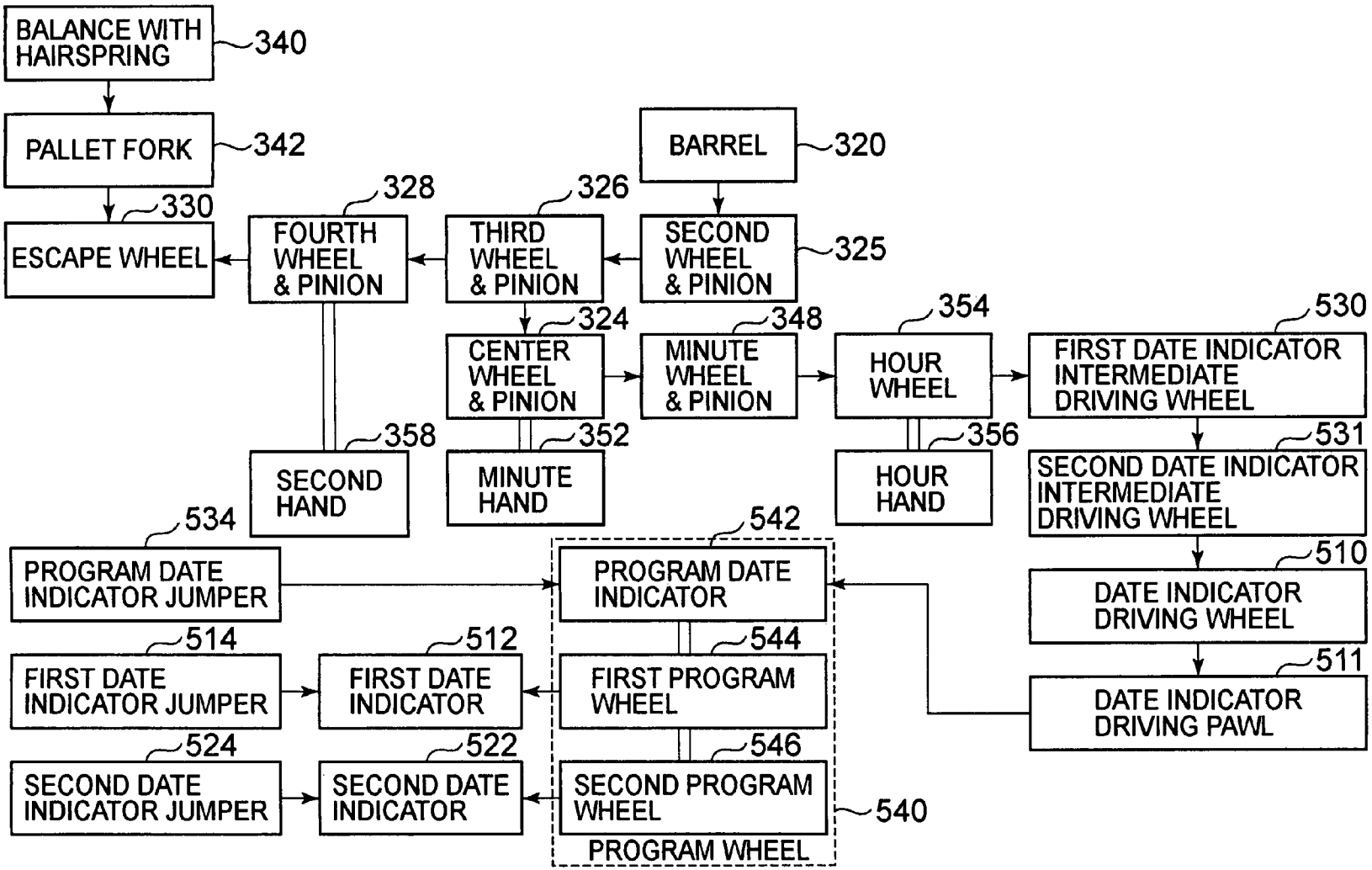
FIG. 12 is a block diagram showing drive mechanism, front train wheel, calendar mechanism, and so on in the first embodiment of the calendar mechanism-equipped timepiece of the present invention.

Referring to FIGS. 1–3 and 12, when the stem 310 is rotated in the first direction under conditions where the stem 310 has been pulled out to the first stage, the calendar correction wheel 592 is rotated via rotations of the clutch wheel 311, setting wheel 376, first calendar correction wheel 590, and second calendar correction wheel 591. Thus, the program wheel 540 rotates an amount corresponding to one tooth in a clockwise direction. The first program gear 544 rotates the first date indicator 512 an amount corresponding to one tooth in a counter clockwise direction. The date character displayed from the date window 104*g* by the first date indicator 512 can be varied from "9" to "0". Simultaneously with rotation of the first date indicator 512 by the first program gear 544, the second program gear 546 rotates the second date indicator 522 an amount corresponding to one tooth in a counterclockwise direction. Thus, the date character displayed from the date window 104*g* by the second date indicator 522 can be varied from "2" to "3". As shown in FIGS. 8 and 12, when the corrective operation as described above is performed, "3" is displayed by the second date characters 522*h* on the second date indicator 522, and "0" is displayed by the first day characters 512*h* on the first date indicator 512. It is possible to display "30th day" from the date window 104*g* by the second date indicator 522 and first date indicator 512.

(2) Second Embodiment

A second embodiment of the calendar mechanism-equipped timepiece of the present invention is next described. The following description centers on the differences of the second embodiment of the calendar mechanism-equipped timepiece of the present invention from the first embodiment of the calendar mechanism-equipped timepiece of the present invention. Accordingly, in parts not specifically stated below, the description of the above-described first embodiment of the calendar mechanism-equipped timepiece of the present invention is applied here.

(2-1) Structure of the Second Embodiment

The structure of the second embodiment of the calendar mechanism-equipped timepiece of the present invention is hereinafter described. Referring to FIGS. 1–4 and 9–11, in a movement 190, a program wheel 560 includes a program date indicator 562, a first program gear 564, and a second program gear 566. The program date indicator 562 is identical in structure with the program date indicator 542 of the first embodiment. The first program gear 564 is identical in structure with the first program gear 544 of the first embodiment. In the program wheel 560 shown in FIGS. 18–22, a trapezoidal portion that is colored totally black indicates portions in which tooth portions are present in both the first program gear 564 and second program gear 566. A trapezoidal portion that is not colored totally black indicates portions in which tooth portions are present only in the first program gear 564. The second program gear 566 has four tooth portions. The angular spacing between the tooth portions of the second program gear 566 are respectively 10*360/30 degrees, 10*360/30 degrees, 10*360/30 degrees, and 2*360/30 degrees in this order.

Figure 19:
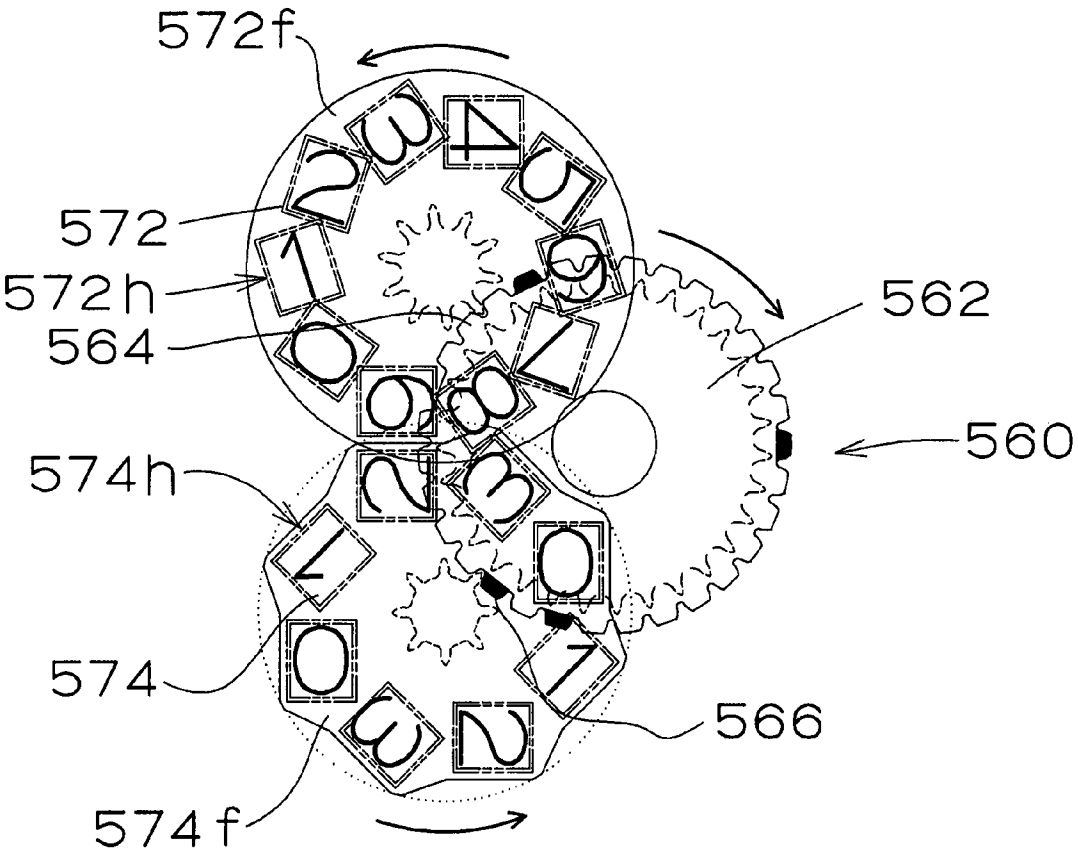
FIG. 19 is an enlarged fragmentary plan view showing portions of first date indicator, second date indicator, and program gear under the condition where "29th day" is being displayed in the second embodiment of the calendar mechanism-equipped timepiece of the present invention.

Referring to FIG. 19, FIG. 19 shows the state in which a first date indicator 572 in the calendar mechanism-equipped timepiece of the present invention displays "9" from the date window 104*f* of the dial 104 and a second date indicator 574 displays "2", indicating that the date is "29th day (of the month)". First day characters 572*h* consisting of 10 numerals are provided on the first date character display surface 512*f* of the first date indicator 572. The first day characters 572 include numerals "0", "1", "2", "3", "4", "5", "6", "7", "8", and "9" arrayed in this order in a peripheral direction. The ten numerals constituting the first day characters 572*h* are arranged on the first date character display surface 512*f* at an equal angular spacing, i.e., at a spacing of (360/10) degrees.

Second date characters 574*h* consisting of 8 numerals are provided on a second date character display surface 574*f* of the second date indicator 574. The second date characters 574*h* include numerals "0", "1", "2", "3", "0", "1", "2", and "1" arrayed in this order in the peripheral direction. The 8 numerals constituting the second day characters 522*h* are arranged on the second date character display surface 522*f* at an equal angular spacing, i.e., at a spacing of (360/8) degrees. In the state shown in FIG. 19, "2" of the second date characters 574*h* is arranged in the date window 104*f*. When the second date indicator 575 rotates one pitch in the direction indicated by the arrow, "3" of the second date characters 574*h* is arranged in the date window 104*f*. Subsequently, when the second date wheel 574 rotates one pitch in the direction indicated by the arrow, a successive one of "0", "1", "2", "3", "0", "1", "2", and "3", of the second date characters 574*h* is similarly arranged in this order in the date window 104*f*. Alternatively, instead of providing a numeral "0" on the second date indicator 574, a blank portion (i.e., a plain portion having no numeral) may be formed in that position.

(2-2) Operation of the Second Embodiment

The operation of the second embodiment of the calendar mechanism-equipped timepiece of the present invention is hereinafter described. Referring to FIG. 19, the state shown in FIG. 19 is that "2" of the second day characters 574*h* is arranged in the left portion in the date window 104*f* and "9" of the first date characters 572*h* is arranged in the left portion of the date window 104*f*.

Figure 18:
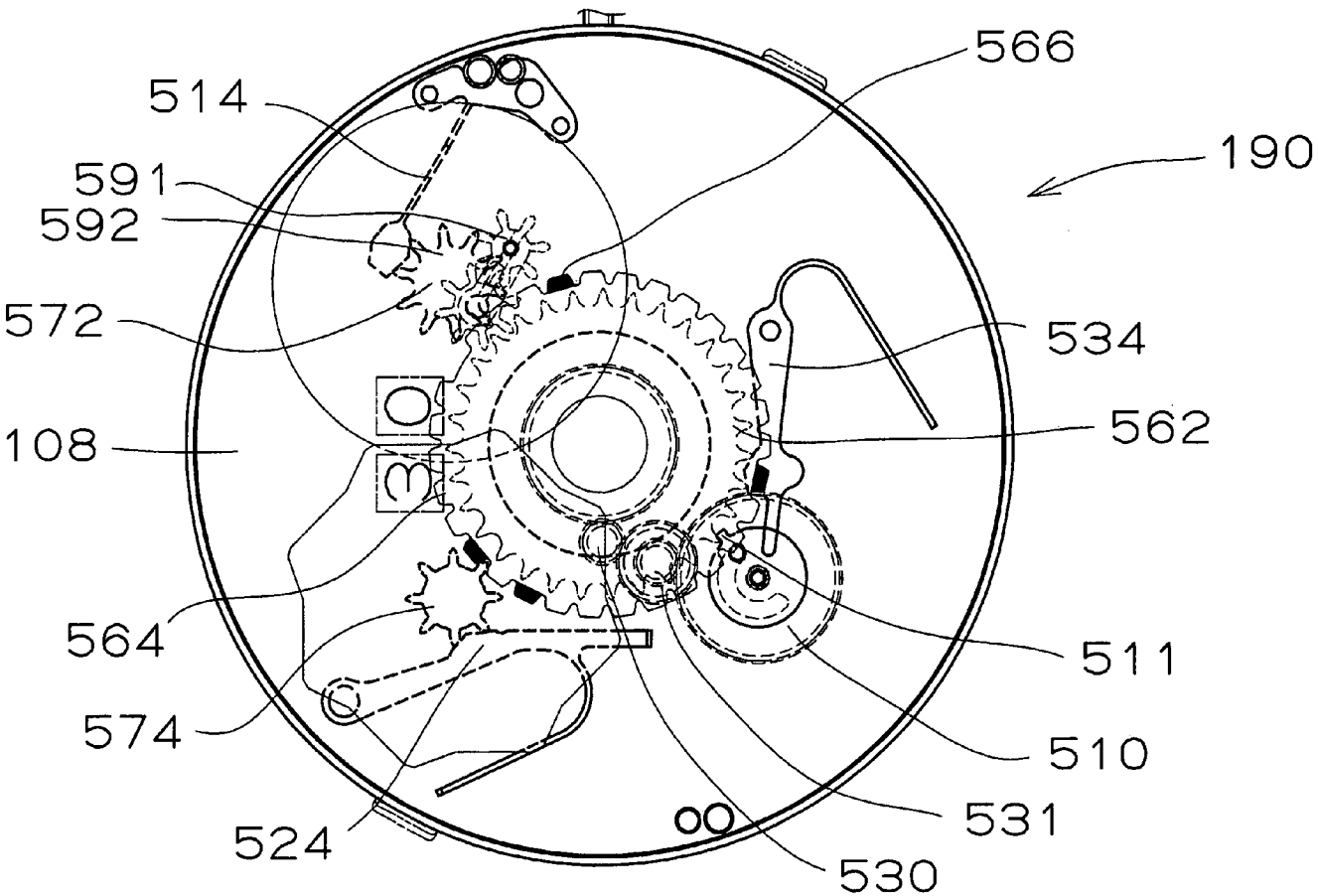
FIG. 18 is a schematic plan view showing arrangement and interrelations of first date indicator, second date indicator, and program gear when the movement is viewed from the dial side in a second embodiment of the calendar mechanism-equipped timepiece of the present invention.
Figure 20:
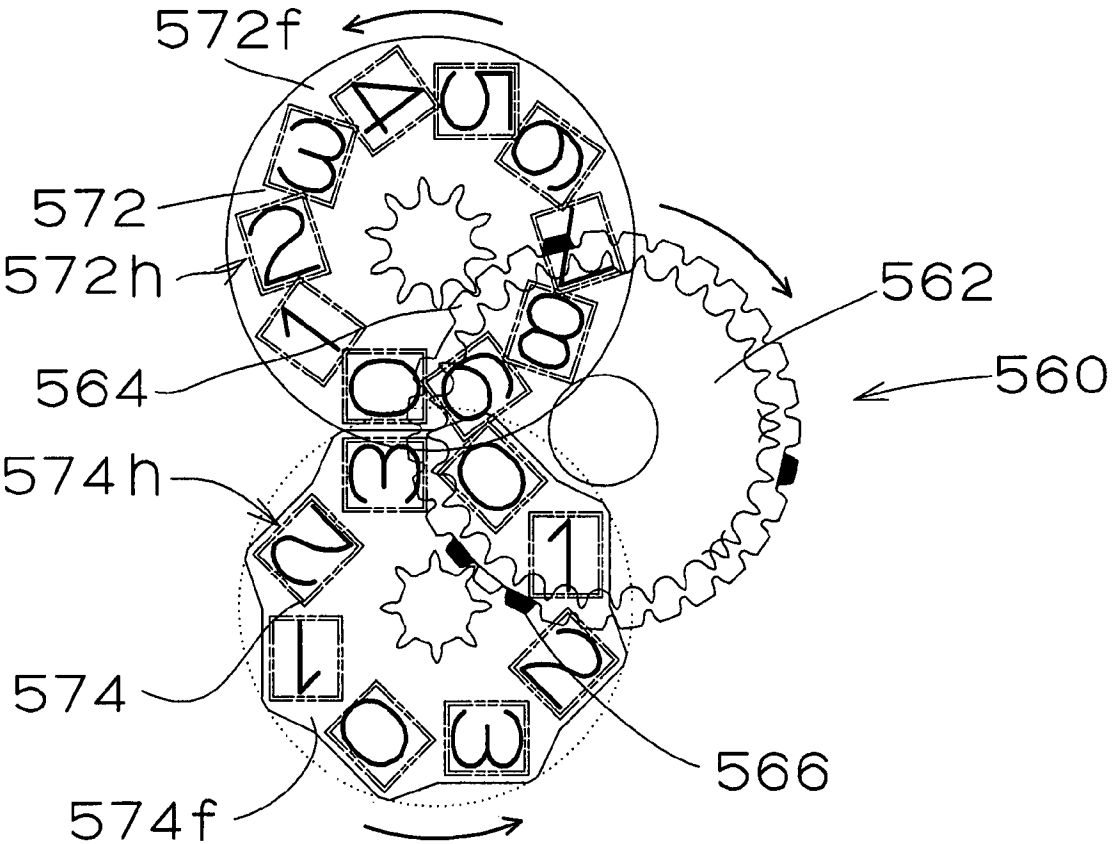
FIG. 20 is an enlarged fragmentary plan view showing portions of first date indicator, second date indicator, and program gear under the condition where "30th day" is being displayed in the second embodiment of the calendar mechanism-equipped timepiece of the present invention.

Referring to FIGS. 18 and 19, the date indicator driving wheel 510 is rotated by rotation of the hour wheel 354 via rotations of the first date indicator intermediate driving wheel 530 and the second date indicator intermediate driving wheel 531. The date indicator driving pawl 511 rotates the program wheel 560 an amount corresponding to one tooth once every day in a clockwise direction. As the program wheel 560 rotates, the first program gear 564 rotates the first date indicator 572 an amount corresponding to one tooth in a counterclockwise direction, thus varying the date character displayed from the date window 104*g* by the first date indicator 572 from "9" to "0". Simultaneously with rotation of the first date indicator 572 by the first program gear 564, the second program gear 566 rotates the second date indicator 574 an amount corresponding to one tooth in a counterclockwise direction, thus varying the date character displayed from the date window 104*g* by the second date indicator 574 from "2" to "3". Accordingly, as shown in FIG. 20, by the operation for date feeding as described above, the second date characters 574*h* on the second date indicator 574 display "3", and the first date characters 572*h* on the first date indicator 572 display "0". It is possible to display "30th day (of the month)" from the date window 104*g* by the second date indicator 574 and the first date indicator 572.

Figure 21:
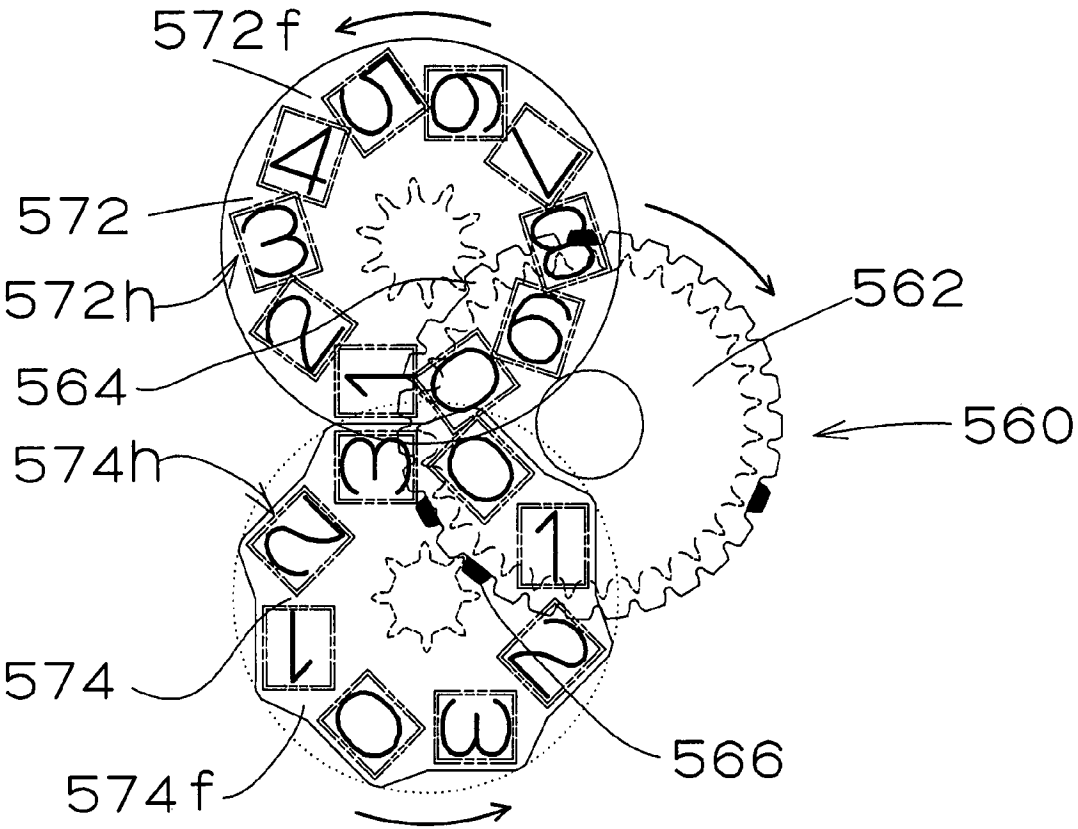
FIG. 21 is an enlarged fragmentary plan view showing portions of first date indicator, second date indicator, and program gear under the condition where "31st day" is being displayed in the second embodiment of the calendar mechanism-equipped timepiece of the present invention.

Referring to FIGS. 18 and 20, by rotating the hour wheel 354 further, the date indicator driving wheel 510 is rotated via rotations of the first date indicator intermediate driving wheel 530 and the second date indicator intermediate driving wheel 531. The date indicator driving pawl 511 rotates the program wheel 560 an amount corresponding to one tooth once every day in a clockwise direction. Because the program wheel 560 is rotated, the first program gear 564 rotates the first date indicator 572 an amount corresponding to one tooth in a counterclockwise direction. This varies the date character displayed from the date window 104*g* by the date indicator 572 from "0" to "1". At this time, the second program gear 566 does not rotate the second date indicator 574. The date character displayed from the date window 104*g* by the second date indicator 574 remains "3". Accordingly, as shown in FIG. 21, because of the operation for date feeding as described above, the second date characters 522*h* on the second date indicator 572 display "3". The first date characters 572*h* on the first date indicator 572 display "1". The second date indicator 574 and the first date indicator 572 can display "31st day (of the month)" from the date window 104*g*.

Figure 22:
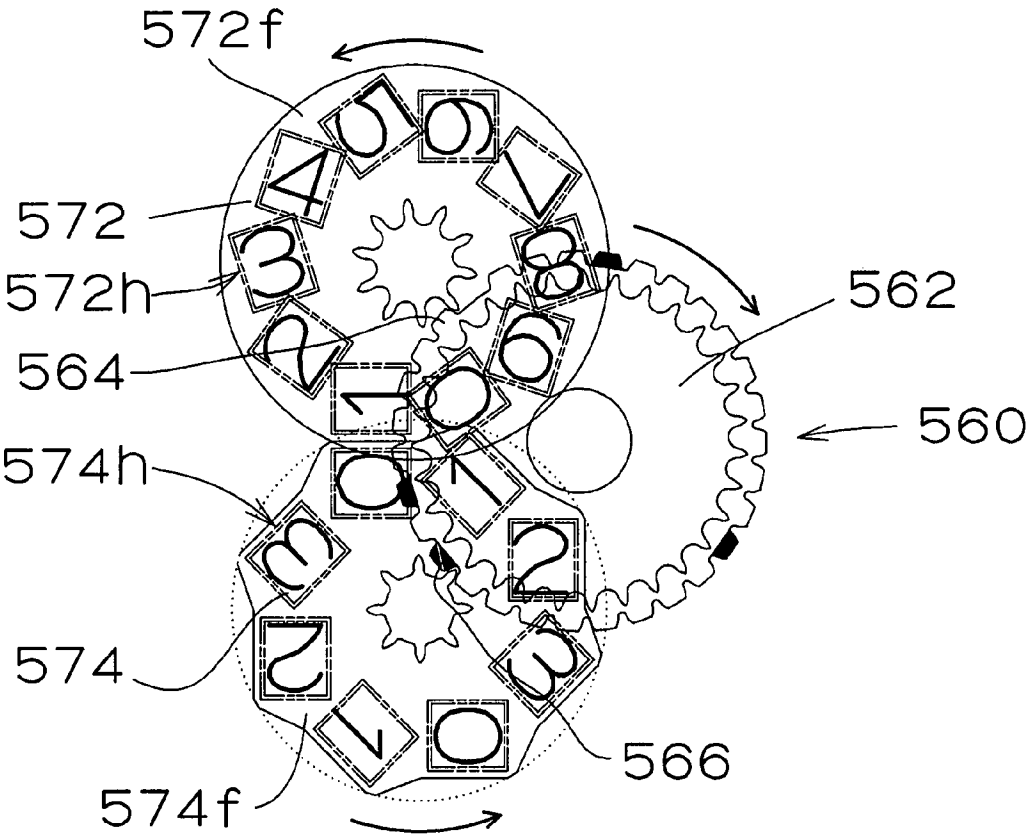
FIG. 22 is an enlarged fragmentary plan view showing portions of first date indicator, second date indicator, and program gear under the condition where "01st day" is being displayed in the second embodiment of the calendar mechanism-equipped timepiece of the present invention.

Referring to FIGS. 18 and 21, further rotation of the hour wheel 354 causes the date indicator driving wheel 510 to rotate via rotations of the first date indicator intermediate driving wheel 530 and the second date indicator intermediate driving wheel 531. The date indicator driving pawl 511 rotates the program wheel 560 an amount corresponding to one tooth once every day in a clockwise direction. In the case where the program wheel 560 rotates, the first program gear 564 does not rotate the first date indicator 572. The date character displayed from the date window 104*g* by the first date indicator 572 remains "1". At this time, the second program gear 566 rotates the second date indicator 574 an amount corresponding to one tooth in a counterclockwise direction. This varies the date character displayed from the date window 104*g* by the second date indicator 574 from "3" to "0". Accordingly, as shown in FIG. 22, because of the operation for date feeding as described above, the second date characters 574*h* on the second date indicator 574 display "0". The first date characters 572*h* on the first date indicator 572 display "1". The second date indicator 574 and the first date indicator 572 can display "01st day (of the month)" (i.e., "1st day") from the date window 104*g*.

Referring to FIGS. 18 and 22, further rotation of the hour wheel 354 causes the date indicator driving wheel 510 to rotate via rotations of the first date indicator intermediate driving wheel 530 and the second date indicator intermediate driving wheel 531. The date indicator driving pawl 511 rotates the program wheel 560 an amount corresponding to one tooth once every day in a clockwise direction. Because the program wheel 560 is rotated, the first program gear 564 rotates the first date indicator 572 an amount corresponding to one tooth in a counterclockwise direction. This varies the date character displayed from the date window 104*g* by the date indicator 572 from "1" to "2". When the first program gear 564 rotates the first date indicator 572, the second program gear 566 does not rotate the second date indicator 574. The date character displayed from the date window 104*g* by the second date indicator 574 remains "0". Accordingly, because of the operation for date feeding as described above, the second date characters 574*h* on the second date indicator 574 display "0". The first date characters 572*h* on the first date indicator 572 display "2". The second date indicator 574 and the first date indicator 572 can display "02nd day (of the month)" (i.e., "2nd day") from the date window 104*g*.

The hour wheel 354 rotates further, whereby the program wheel 560 rotates only once a day. The first program gear 564 rotates the first date indicator 572 an amount corresponding to one tooth in a counterclockwise direction. This varies the date character displayed from the date window 104*g* by the first date indicator 572 to "3". By performing these operations, "03rd day", "04th day", "05th day", "06th day", "07th day", "08th day", and "09th day" can be displayed in turn from the date window 104*g* by the second date indicator 574 and the first date indicator 572. Because of this structure, a calendar mechanism-equipped timepiece including a large calendar display which is easy to see can be accomplished.

The hour wheel 354 rotates further, whereby the date indicator driving wheel 510 is rotated via rotations of the first date indicator intermediate driving wheel 530 and the second date indicator intermediate driving wheel 531. The date indicator driving pawl 511 rotates the program wheel 560 an amount corresponding to one tooth once every day in a clockwise direction. Because the program wheel 560 is rotated, the first program gear 564 rotates the first date indicator 572 an amount corresponding to one tooth in a counterclockwise direction. This varies the date character displayed from the date window 104*g* by the date indicator 572 from "9" to "0". Simultaneously with rotation of the first date indicator 572 by the first program gear 564, the second program gear 566 rotates the second date indicator 574 an amount corresponding to one tooth in a counterclockwise direction, thus varying the date character displayed from the date window 104*g* by the second date indicator 574 from "0" to "1". Accordingly, by the operation for date feeding as described above, the second date characters 574*h* on the second date indicator 574 display "1", and the first date characters 572*h* on the first date indicator 572 display "0". It is possible to display "10th day" from the date window 104*g* by the second date indicator 574 and the first date indicator 572. Subsequently, in the second embodiment of the calendar mechanism-equipped timepiece of the present invention, these operations are also repeated every 10 days. It is possible to display from "01st day" to "31st day" from the date window 104*g* by the second date indicator 574 and the first date indicator 572.

(3) Third Embodiment

The third embodiment of the calendar mechanism-equipped timepiece of the present invention is next described. The following description centers on the differences of the third embodiment of the calendar mechanism-equipped timepiece of the present invention from the first embodiment of the calendar mechanism-equipped timepiece of the present invention. Accordingly, in parts not specifically stated below, the description of the above-described first embodiment of the calendar mechanism-equipped timepiece of the present invention is applied here. The third embodiment of the calendar mechanism-equipped timepiece of the present invention is an analog electronic timepiece.

(3-1) Whole Structure of Movement

Figure 23:
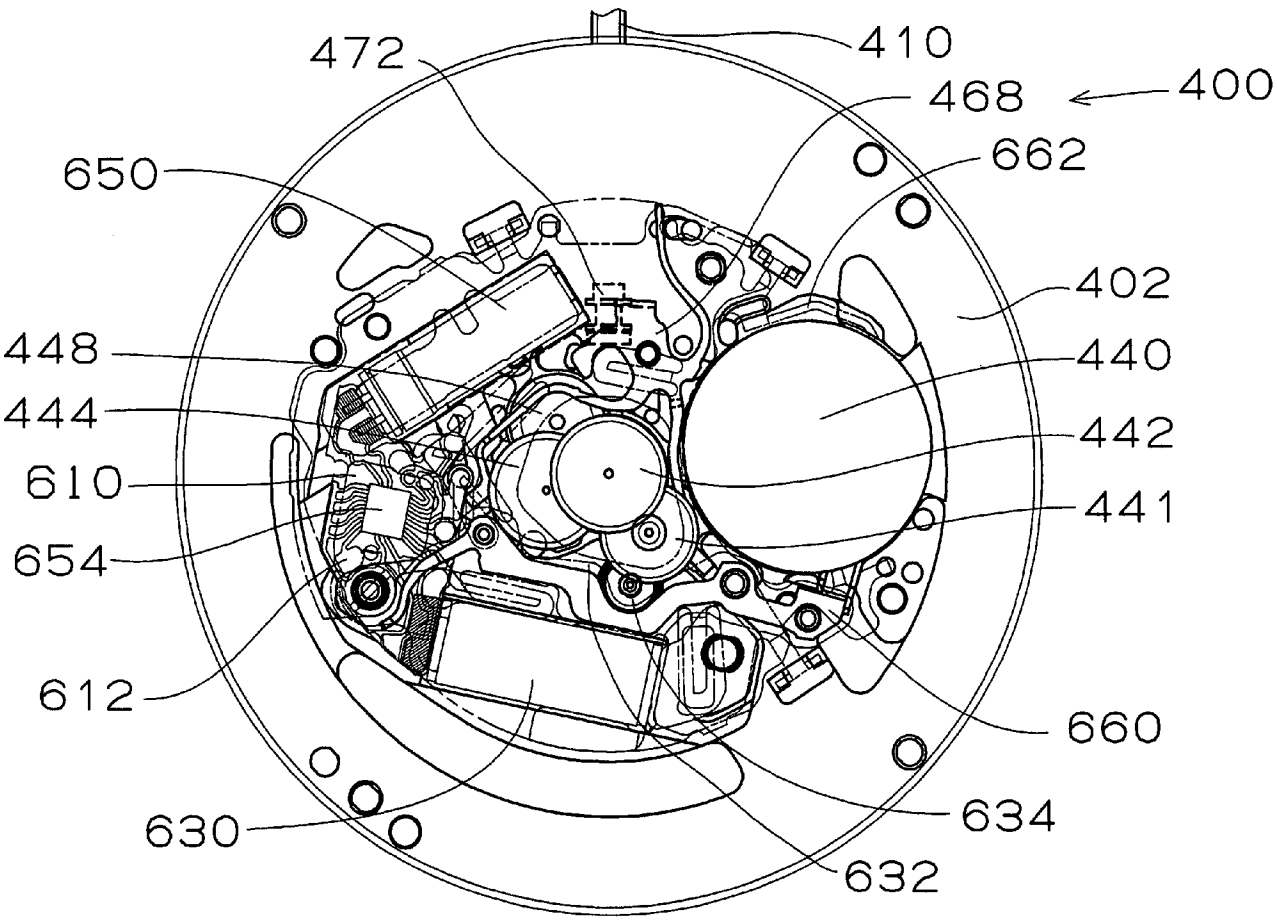
FIG. 23 is a schematic plan view showing a structure when the movement is viewed from the rear cover side in a third embodiment of the calendar mechanism-equipped timepiece of the present invention.
Figure 24:
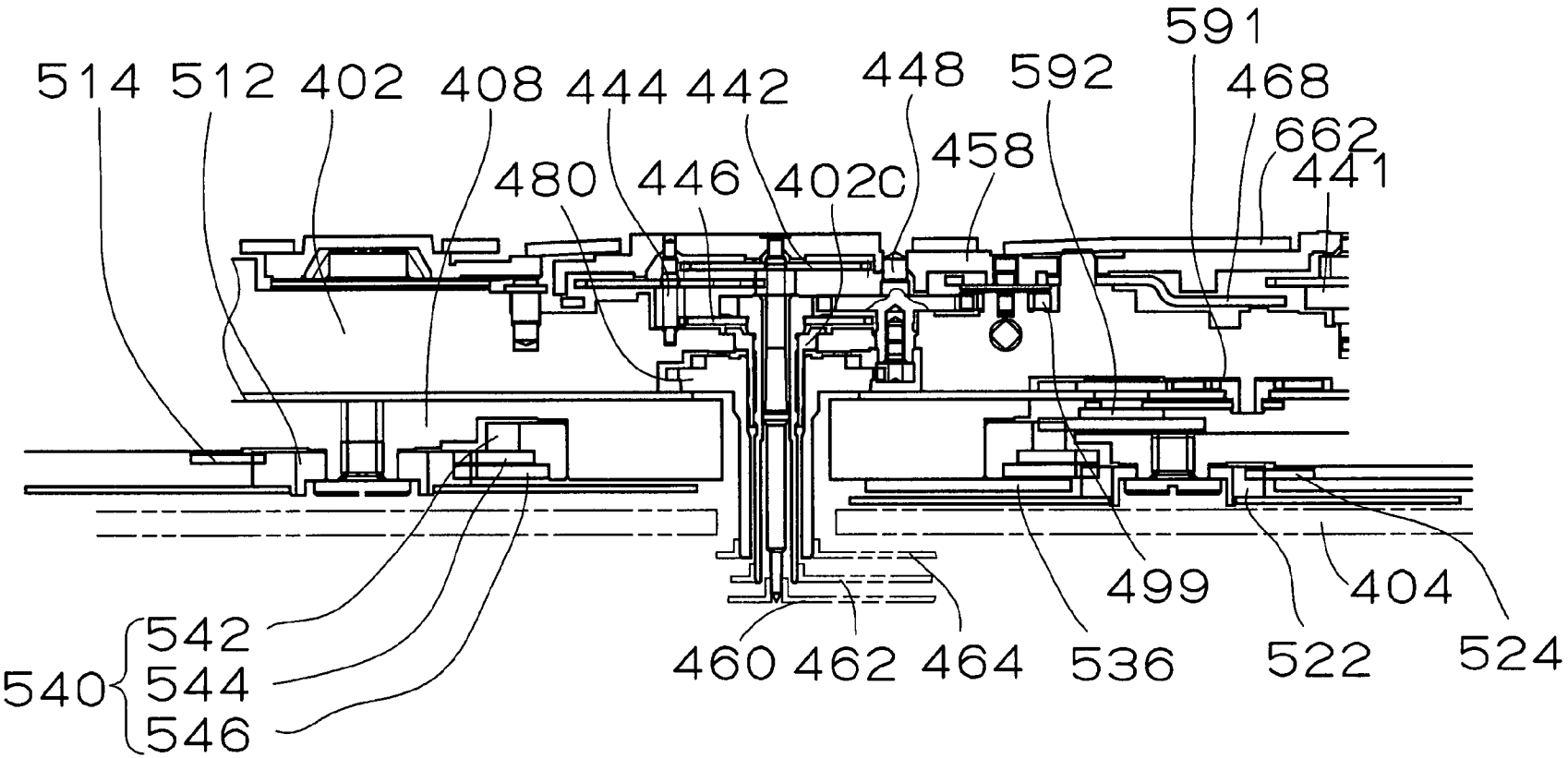
FIG. 24 is a fragmentary sectioned view showing drive mechanism, front train wheel, calendar mechanism, and so on in the third embodiment of the calendar mechanism-equipped timepiece of the present invention.

Referring to FIGS. 23 and 24, in the third embodiment of the calendar mechanism-equipped timepiece of the present invention, a movement 400 is constituted by an analog electronic timepiece. The movement 400 includes a bottom plate or main plate 402 forming the base plate of the movement 400. A dial 404 is attached to the movement 400. A stem 410 is rotatably mounted in the bottomplate 402. A clutch wheel 472 is disposed such that its axis of rotation is coincident with the axis of rotation of the stem 410. A battery 440 constituting the power source of the timepiece is disposed on the rear cover side (front side) of the bottom plate 402. A quartz unit 650 constituting a vibration source for the timepiece is disposed on the rear cover side of the bottom plate 402. A quartz oscillator oscillating, for example, at 32,768 hertz is accommodated in the quartz unit 650. An oscillator portion for producing a reference signal based on vibrations of the quartz oscillator, a frequency division control portion for frequency-dividing the output signal from the oscillator portion and controlling the operation of a stepping motor, and a motor driver portion for outputting a motor drive signal driving the stepping motor based on the output signal from the frequency division control portion are incorporated in an integrated circuit (IC) 654. The integrated circuit 654 is made up of CMOSes or a PLA, for example. Where the integrated circuit 654 is fabricated from CMOSes, the oscillator portion, frequency division control portion, and motor driver portion are incorporated in the integrated circuit 654. Where the integrated circuit (IC) 654 is made of a PLA, the oscillator portion, frequency division control portion, and motor driver portion are operated by a program stored in the PLA.

The quartz unit 650 and integrated circuit 654 are fixed to a circuit substrate 610. The circuit substrate 610, quartz unit 650, and integrated circuit 654 constitute a circuit block 612. The circuit block 612 is disposed on the rear cover side of the bottom plate 402. Furthermore, in the calendar-equipped timepiece of the present invention, externally attached elements such as resistors, capacitors, coils, and diodes can be used according to the need. A battery negative terminal 660 is mounted to electrically connect the cathode of the battery 440 and the negative pattern on the circuit substrate 610. A battery positive terminal 662 is mounted to electrically connect the anode of the battery 440 and the positive pattern on the circuit substrate 610. A coil block 630 including a coil wire wound on a magnetic core, a stator 632 disposed in contact with both end portions of the core of the coil block 630, and a rotor 634 including a rotor magnet 634*b* disposed in a rotor hole 632*c* in the stator 632 are disposed on the rear cover side of the bottom plate 402. The coil block 630, stator 632, and rotor 634 constitute the stepping motor. A fifth wheel & pinion 441 is designed to be rotated by rotation of the rotor 634. A fourth wheel & pinion 442 is designed to be rotated by rotation of the fifth wheel & pinion 441. A third wheel & pinion 444 is designed to be rotated by rotation of the fourth wheel & pinion 442. A center wheel & pinion 446 is designed to be rotated by rotation of the third wheel & pinion 444. A minute wheel & pinion 448 is designed to be rotated by rotation of the center wheel & pinion 446. A hour wheel 480 is designed to be rotated by rotation of the hour wheel & pinion 448.

The fourth wheel & pinion 442 is designed to be rotated once per minute. A minute hand 460 is attached to the fourth wheel & pinion 442. The center wheel & pinion 446 is designed to be rotated once every hour. A minute hand 462 is attached to the center wheel & pinion 446. A slip mechanism is mounted to the center wheel & pinion 446. The slip mechanism permits the minute hand 462 and hour hand 464 to be rotated by rotating the stem 410 when the hands are corrected while the second hand 460 is stopped. When the hands are corrected after pulling out the stem 410 to the second stage, the tooth portions of the fifth wheel & pinion 441 are controlled or adjusted and the rotation of the second hand 460 is stopped. For this purpose, a train wheel setting lever 468 is mounted. A center pipe 402*c* is fixedly mounted to the bottom plate 402. The center pipe 402*c* extends from the rear cover side of the bottom plate 402 to the dial side of the bottom plate 402. The center wheel & pinion 446 is rotatably supported in a hole portion of the center pipe 402*c*. The beads of the fourth wheel & pinion 442 are rotatably supported in the hole portion of the center wheel & pinion 446.

A train wheel bridge 458 is disposed on the rear cover side of the bottom plate 402. An upper shaft portion of the rotor 634, an upper shaft portion of the fifth wheel & pinion 441, an upper shaft portion of the fourth wheel & pinion 442, an upper shaft portion of the third wheel & pinion 444, and an upper shaft portion of the minute wheel & pinion 448 are rotatably supported to the train wheel bridge 458. A lower shaft portion of the rotor 634, a lower shaft portion of the fifth wheel & pinion 441, a lower shaft portion of the third wheel & pinion 444, and a lower shaft portion of the minute wheel & pinion 448 are rotatably supported to the bottom plate 402. The hour wheel 480 is designed to be rotated once every 12 hours. The hour hand 464 is attached to the hour wheel 480. Because of the hour hand 464 attached to the hour wheel 480, the "time" is displayed by the 12 hour time system in which one rotation gives 12 hours. The minute gear of the minute wheel & pinion 448 is arranged to mesh with a setting gear 449. The setting gear 449 is positioned between the bottom plate 402 and the train wheel bridge 458. The minute pinion (not shown) of the minute wheel & pinion 448 is located on the dial side of the bottom plate 402 and designed to mesh with the hour gear of the hour wheel 480. The hole portion of the hour wheel 480 is rotatably supported to the outer periphery portion of the shaft portion of the center pipe 402*c*.

(3-2) Operation of the Third Embodiment

Figure 25:
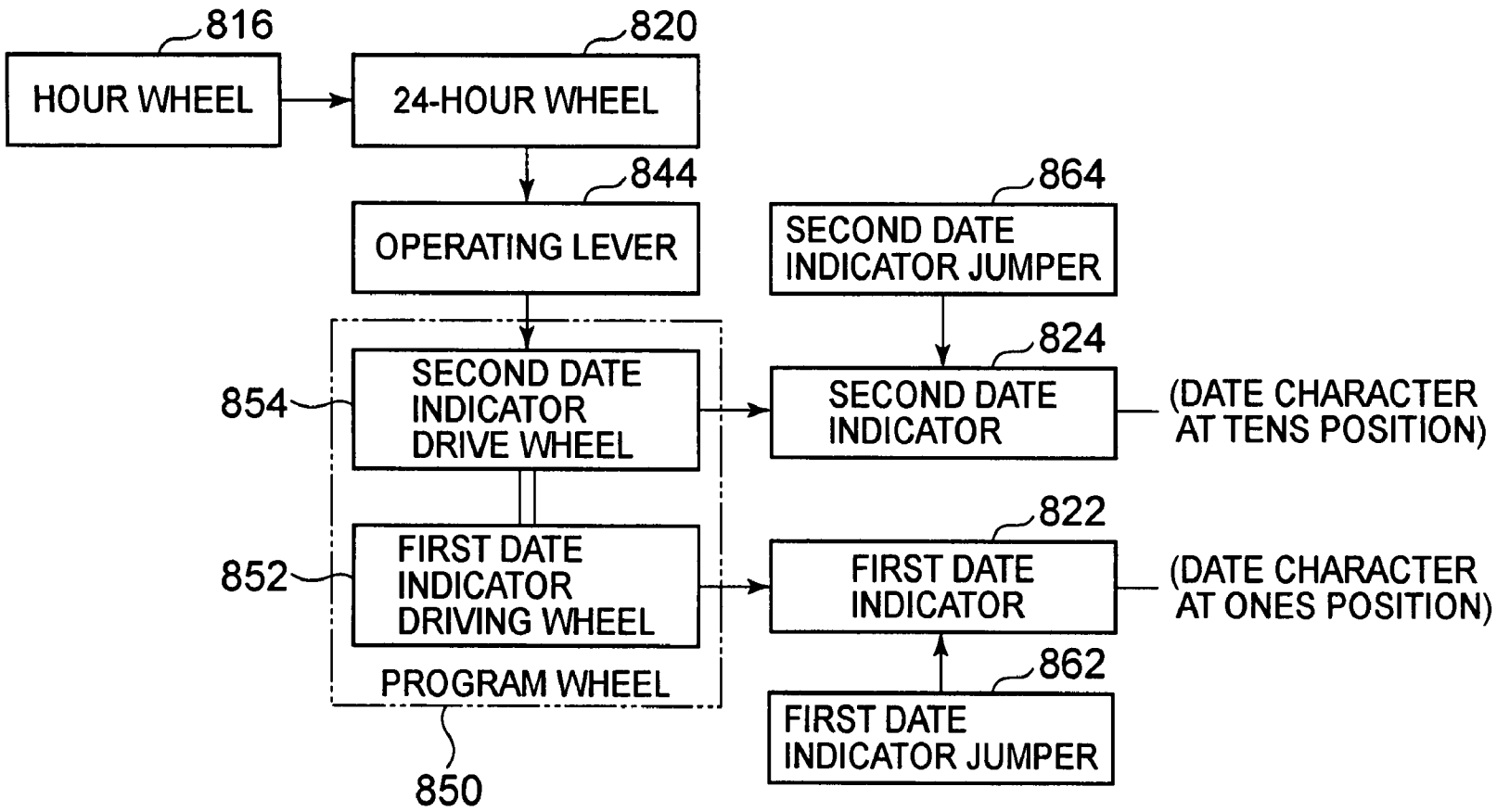
FIG. 25 Prior Art
FIG. 25 is a block diagram showing the structure of a calendar mechanism in a calendar mechanism-equipped timepiece of the prior art first type.
Figure 26:
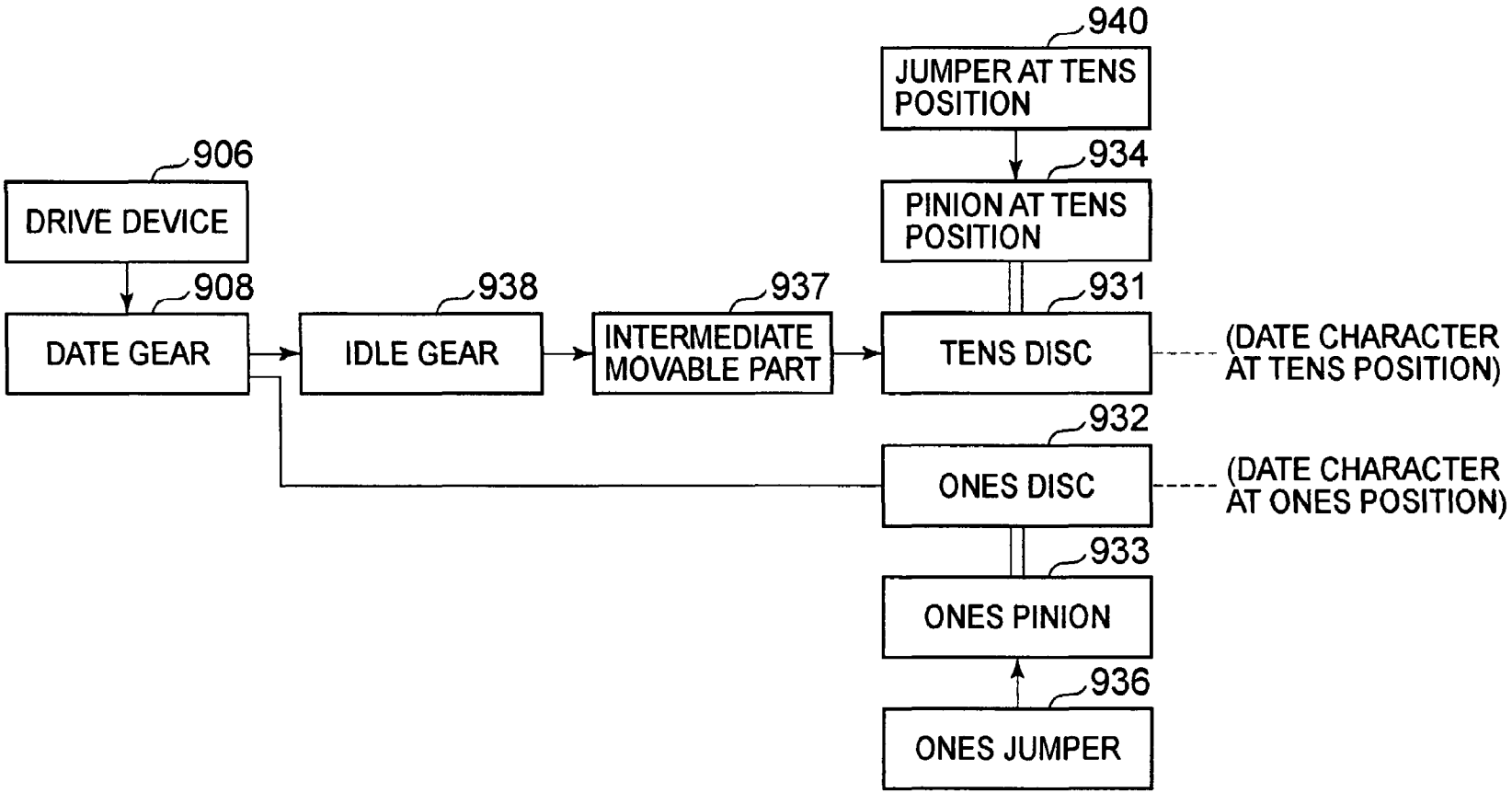
FIG. 26 Prior Art
FIG. 26 is a block diagram showing the structure of a calendar mechanism in a calendar mechanism-equipped timepiece of the prior art second type.

The operation of the hands when they are in normal motion in the third embodiment of the calendar mechanism-equipped timepiece of the present invention is next described. Referring to FIGS. 24 and 25, the battery 440 constitutes the power source of the timepiece. The quartz oscillator accommodated in the quartz unit. 650 oscillates, for example, at 32, 768 hertz based on vibrations of the quartz oscillator. The oscillator portion built in the integrated circuit 654 outputs a reference signal. The frequency division control portion frequency-divides the output signal from the oscillator portion. The motor driver portion outputs a motor driver signal for driving a stepping motor to the coil block 630 based on the output signal from the frequency division control circuit. When the coil block 630 accepts the motor driver signal, the stator 632 is magnetized, rotating the rotor 634. The rotor 634 rotates through 180 degrees, for example, every second. Based on rotation of the rotor 634, the fourth wheel & pinion 442 is rotated via rotation of the fifth wheel & pinion 441. The fourth wheel & pinion 442 rotates once every minute. Because of the second hand 460 attached to the fourth wheel & pinion 442, "seconds" of the time information are displayed. The third wheel & pinion 444 is rotated based on rotation of the fourth wheel & pinion 442.

The center wheel & pinion 446 is rotated based on rotation of the third wheel & pinion 444. Instead of the center wheel & pinion 446, a center wheel may be used. The center wheel & pinion 446 rotates once every hour. Because of the minute hand 462 attached to the center wheel & pinion 446, "minutes" of the time information are displayed. A slip mechanism is mounted to the center wheel & pinion 446. The slip mechanism permits the minute hand 462 and hour hand 464 to be rotated by rotating the stem 410 when the hands are corrected while the tooth portions of the fifth wheel & pinion 442 are corrected or reset by the train wheel setting lever 468 and the second hand 460 is stopped. The minute wheel & pinion 448 is rotated based on rotation of the center wheel & pinion 446. The hour wheel 480 is rotated based on rotation of the minute wheel & pinion 448. The hour wheel 480 rotates once every 12 hours. By the hour hand 464 attached to the hour wheel 480, "hours" of the time information are displayed.

In the third embodiment of the calendar mechanism-equipped timepiece of the present invention, the advantages of the calendar feeding, the advantages of the date correction, and so on are identical with the advantages of the first embodiment of the calendar mechanism-equipped timepiece of the present invention. That is, the date indicator driving wheel 510 is rotated by rotation of the hour wheel 480 via rotations of the first date indicator intermediate driving wheel 530 and second date indicator intermediate driving wheel 531. The date indicator driving pawl 511 rotates the program wheel 540 an amount corresponding to one tooth in a clockwise direction only once per day. The rotation of the program wheel 540 causes the first program gear 544 to rotate the first date indicator 512 an amount corresponding to one tooth in a counterclockwise direction. The date character displayed from the date window 104*g* by the first date indicator 512 can be varied. Simultaneously with rotation of the first date indicator 512 by the first program gear 544, the second program gear 546 rotates the second date indicator 522 an amount corresponding to one tooth in a counterclockwise direction. The date character displayed from the date window 104*g* by the second date indicator 522 can be varied. The above-described operations for date feeding are completed when the hour hand 356 and the minute hand 352 display 12:00.

In the calendar mechanism-equipped timepiece of the present invention, the drive mechanism for driving the first and second date indicators is simple. The area occupied by the drive mechanism is small. Accordingly, the calendar mechanism-equipped timepiece of the present invention is small in size and thin. Furthermore, the calendar mechanism-equipped timepiece of the present invention provides a large calendar display which is easy to see. In addition, in the calendar mechanism-equipped timepiece of the present invention, large latitude is offered in designing the calendar correction mechanism.

Application of the present invention makes it possible to obtain a calendar mechanism-equipped timepiece which is small in size and thin and which provides a large calendar display that is easy to see.

What is claimed is:

1. A timepiece equipped with a calendar mechanism including two date indicators comprising:

a drive mechanism for driving the timepiece equipped with the calendar mechanism;

time display wheels that are rotated by operation of said drive mechanism to thereby display time information;

a first date indicator for displaying an ones digit of the date;

a second date indicator for displaying a tens digit of the date; and a program gear designed to be capable of intermittently rotating said first date indicator and said second date indicator based on operation of said drive mechanism;

wherein center axis of rotation of said time display wheels is located inside a center hole in said program gear under conditions where said time display wheels are rotatable; and wherein information about the date can be displayed by means of one of first date characters provided on the first date indicator and one of second date characters provided on said second date indicator, the first and second date indicators being placed in position adjacently to each other.

2. A timepiece equipped with a calendar mechanism according to claim 1, wherein the center axis of rotation of said program gear is designed to be coincident with the center axis of rotation of said time display wheels.

3. A timepiece equipped with a calendar mechanism according to claim 1, wherein said program gear includes a program date indicator designed to be rotated based on operation of said drive mechanism, a first program gear designed to be capable of rotating as a unit with said program date indicator and of intermittently rotating said first date indicator, and a second program gear designed to be capable of rotating as a unit with said program date indicator and of intermittently rotating said second date indicator.

4. A timepiece equipped with a calendar mechanism according to claim 3, wherein said program date indicator has 31 tooth portions for accepting operation of said drive mechanism, said first program gear has 30 tooth portions for rotating said first date indicator, said second program gear has 8 tooth portions for rotating said second date indicator, wherein said first date indicator has a first date character display surface including 10 numerals "1", "2", "3", "4", "5", "6", "7", "8", "9", and "0" arrayed in this order in a peripheral direction, and said second date indicator has a second date character display surface including 8 numerals "0", "0", "1", "1", "2", "2", "3", and "3" arrayed in this order in the peripheral direction.

5. A timepiece equipped with a calendar mechanism according to claim 3, wherein said program date indicator has 31 tooth portions for accepting operation of said drive mechanism, said first program gear has 30 tooth portions for rotating said first date indicator, said second program gear has 4 tooth portions for rotating said second date indicator, said first date indicator has a first date character display surface including 10 numerals "1", "2", "3", "4", "5", "6", "7", "8", "9", and "0" arrayed in this order in a peripheral direction, and said second date indicator has a second day character display surface including 8 numerals "0", "1", "2", "3", "0", "1", "2", and "3"arrayed in this order in a peripheral direction.

6. A timepiece equipped with a calendar mechanism according to claim 3, further comprising day indicator intermediate driving wheels designed to be rotated based on operation of said drive-mechanism and be arranged to overlap said program gear, a date indicator driving wheel designed to be rotated based on rotation of said date indicator intermediate driving wheels, and a date indicator driving pawl designed to be rotated based on rotation of said date indicator driving wheel, wherein said program date indicator is designed to be rotated based on rotation of said date indicator driving pawl.

7. A timepiece equipped with a calendar mechanism according to claim 3, further comprising a program date indicator jumper for correcting or resetting rotation of said program date indicator, a first date indicator jumper for correcting or resetting rotation of said first date indicator, and a second date indicator jumper for correcting or resetting rotation of said second date indicator.

8. A timepiece equipped with a calendar mechanism according to claim 3, further comprising a calendar correction mechanism capable of correcting contents of display of said first date indicator and/or contents of display of said second date indicator by rotating a stem under conditions where the stem has been pulled out into a stem position where a calendar correction can be made;

wherein said calendar correction mechanism includes a calendar correction wheel, and said calendar correction wheel is rotated based on rotation of said stem under conditions where the stem has been pulled out into the stem position where a calendar correction can be made, whereby said program wheel can be rotated.

* * * * *